US009747905B2

(12) United States Patent
Pang et al.

(10) Patent No.: US 9,747,905 B2
(45) Date of Patent: *Aug. 29, 2017

(54) METHOD AND APPARATUS FOR DECODING AN AUDIO SIGNAL

(75) Inventors: Hee Suk Pang, Seoul (KR); Hyen O Oh, Gyeonggi-do (KR); Dong Soo Kim, Seoul (KR); Jae Hyun Lim, Gwanak-gu (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1032 days.

This patent is subject to a terminal disclaimer.

(21) Appl. No.: 13/104,479

(22) Filed: May 10, 2011

(65) Prior Publication Data

US 2011/0246208 A1 Oct. 6, 2011

Related U.S. Application Data

(63) Continuation of application No. 12/066,650, filed as application No. PCT/KR2006/003662 on Sep. 14, 2006, now abandoned.

(Continued)

(30) Foreign Application Priority Data

Aug. 18, 2006 (KR) ..... 10-2006-0078300

(51) Int. Cl.
*G10L 19/008* (2013.01)

(52) U.S. Cl.
CPC ..... *G10L 19/008* (2013.01)

(58) Field of Classification Search
CPC ..... G10L 19/008; G10L 19/00; G10L 19/167; G10L 19/0204; G10L 19/0017;

(Continued)

(56) References Cited

U.S. PATENT DOCUMENTS 5,166,685 A 11/1992 Campbell et al.
5,524,054 A 6/1996 Spille et al.

(Continued)

FOREIGN PATENT DOCUMENTS

CA 2576739 3/2006
CN 1179074 4/1998

(Continued)

OTHER PUBLICATIONS

US Office Action in U.S. Appl. No. 13/012,641, dated Apr. 11, 2013, 9 pages.

(Continued)

*Primary Examiner* — Ping Lee
(74) *Attorney, Agent, or Firm* — Fish & Richardson P.C.

(57) ABSTRACT

An apparatus for decoding an audio signal and method thereof are disclosed. The present invention includes receiving the audio signal and spatial information, identifying a type of modified spatial information, generating the modified spatial information using the spatial information, and decoding the audio signal using the modified spatial information, wherein the type of the modified spatial information includes at least one of partial spatial information, combined spatial information and expanded spatial information. Accordingly, an audio signal can be decoded into a configuration different from a configuration decided by an encoding apparatus. Even if the number of speakers is smaller or greater than that of multi-channels before execution of downmixing, it is able to generate output channels having the number equal to that of the speakers from a downmix audio signal.

2 Claims, 14 Drawing Sheets

Related U.S. Application Data

(60) Provisional application No. 60/816,022, filed on Jun. 22, 2006, provisional application No. 60/787,516, filed on Mar. 31, 2006, provisional application No. 60/773,669, filed on Feb. 16, 2006, provisional application No. 60/776,724, filed on Feb. 27, 2006, provisional application No. 60/760,360, filed on Jan. 20, 2006, provisional application No. 60/759,980, filed on Jan. 19, 2006, provisional application No. 60/716,524, filed on Sep. 14, 2005.

(58) Field of Classification Search
CPC ..... G10L 21/038; H04S 2420/03; H04S 2400/01; H04S 2400/03; H04S 2420/07; H04S 1/007; H04S 3/02; H04S 7/30; H04R 2217/03; H04R 3/00; H04R 3/005; H04R 3/04; H04R 3/06; H04R 19/04; H04R 1/04; H04R 2410/00; H04R 2410/05; H04R 29/006; H04H 40/26; H04H 20/47
USPC ..... 381/19–23
See application file for complete search history.

(56) References Cited

U.S. PATENT DOCUMENTS

| | | | |
|---|---|---|---|
| 5,579,396 | A | 11/1996 | Iida et al. |
| 5,632,005 | A | 5/1997 | Davis et al. |
| 5,703,584 | A | 12/1997 | Hill et al. |
| 5,912,636 | A | 6/1999 | Gormish |
| 6,118,875 | A | 9/2000 | Moller et al. |
| 6,307,941 | B1 | 10/2001 | Tanner et al. |
| 6,574,339 | B1 | 6/2003 | Kim |
| 6,711,266 | B1 | 3/2004 | Aylward |
| 6,973,130 | B1 | 12/2005 | Wee et al. |
| 7,555,434 | B2 | 6/2009 | Nomura et al. |
| 2003/0236583 | A1 | 12/2003 | Baumgarte et al. |
| 2004/0071445 | A1 | 4/2004 | Tarnoff et al. |
| 2004/0196770 | A1 | 10/2004 | Touyama et al. |
| 2005/0053249 | A1 | 3/2005 | Wu et al. |
| 2005/0074127 | A1 | 4/2005 | Herre et al. |
| 2005/0135643 | A1 | 6/2005 | Lee et al. |
| 2005/0180579 | A1 | 8/2005 | Baumgarte et al. |
| 2005/0195981 | A1 | 9/2005 | Faller et al. |
| 2006/0013405 | A1 | 1/2006 | Oh et al. |
| 2006/0085200 | A1* | 4/2006 | Allamanche ..... H04S 3/02 704/500 |
| 2006/0115100 | A1 | 6/2006 | Faller et al. |
| 2006/0133618 | A1 | 6/2006 | Villemoes et al. |
| 2006/0153408 | A1 | 7/2006 | Faller et al. |
| 2006/0233379 | A1 | 10/2006 | Villemoes et al. |
| 2006/0233380 | A1 | 10/2006 | Holzer et al. |
| 2007/0055510 | A1 | 3/2007 | Hilpert et al. |
| 2007/0121953 | A1 | 5/2007 | Wei |
| 2007/0121954 | A1 | 5/2007 | Kim et al. |
| 2007/0223709 | A1 | 9/2007 | Kim et al. |
| 2007/0233293 | A1* | 10/2007 | Villemoes et al. ..... 700/94 |
| 2007/0233296 | A1* | 10/2007 | Kim et al. ..... 700/94 |
| 2007/0280485 | A1 | 12/2007 | Villemoes |
| 2008/0097750 | A1 | 4/2008 | Seefeldt et al. |
| 2009/0110203 | A1* | 4/2009 | Taleb ..... G10L 19/008 381/17 |
| 2009/0144063 | A1 | 6/2009 | Beack et al. |
| 2009/0172060 | A1 | 7/2009 | Taleb et al. |
| 2011/0178808 | A1 | 7/2011 | Pang et al. |
| 2011/0196687 | A1 | 8/2011 | Pang et al. |

FOREIGN PATENT DOCUMENTS

| | | |
|---|---|---|
| CN | 1281329 | 1/2001 |
| CN | 1402592 | 3/2003 |
| CN | 1647155 | 7/2005 |
| CN | 1655651 | 8/2005 |
| EP | 1455345 | 9/2004 |
| JP | 06-233396 | 8/1994 |
| JP | 07-143596 | 6/1995 |
| JP | 09-275544 | 10/1997 |
| JP | 10-285698 | 10/1998 |
| JP | 2001-188578 | 7/2001 |
| JP | 2001-352599 | 12/2001 |
| JP | 2003-533154 | 11/2003 |
| JP | 2006-166447 | 6/2006 |
| JP | 2007-143596 | 6/2007 |
| JP | 2007-519349 | 7/2007 |
| JP | 2007-525075 | 8/2007 |
| JP | 08-065169 | 3/2008 |
| JP | 08-202397 | 9/2008 |
| JP | 2009-508157 | 2/2009 |
| JP | 2009-508175 | 2/2009 |
| JP | 2009-508176 | 2/2009 |
| JP | 2009-508432 | 2/2009 |
| JP | 2009-508433 | 2/2009 |
| KR | 10-2001-0001993 | 1/2001 |
| KR | 10-2001-0009258 | 2/2001 |
| KR | 10-2003-0043620 | 6/2003 |
| KR | 10-2003-0043622 | 6/2003 |
| RU | 2119259 | 9/1998 |
| RU | 2129336 | 4/1999 |
| RU | 2380767 | 1/2010 |
| TW | 289885 | 11/1996 |
| TW | 550541 | 9/2003 |
| TW | 200304120 | 9/2003 |
| TW | 200405673 | 4/2004 |
| TW | 594675 | 6/2004 |
| WO | 9949574 | 9/1999 |
| WO | WO 03/007656 | 1/2003 |
| WO | 03-090208 | 10/2003 |
| WO | 2004-008805 | 1/2004 |
| WO | 2004-019656 | 3/2004 |
| WO | 2004-036549 | 4/2004 |
| WO | 2004-036954 | 4/2004 |
| WO | 2004-036955 | 4/2004 |
| WO | 2004036548 | 4/2004 |
| WO | WO 2004-072956 | 8/2004 |
| WO | 2005/004537 | 1/2005 |
| WO | WO 2005/036925 | 4/2005 |
| WO | 2005/069274 | 7/2005 |
| WO | 2005/081229 | 9/2005 |

OTHER PUBLICATIONS

Office Action in Taiwan Application No. 095134702, dated Dec. 10, 2012, 10 pages.

Jakka, "Binaural to Multichannel Audio Upmix," Helsinki University of Technology, Master's Thesis, Jun. 6, 2005, pp. 1-59.

Taiwan Office Action in Taiwan Application No. 095134072, dated Jul. 1, 2013, 12 pages.

Office Action, Chinese Appln. No. 200680042198.3, dated Mar. 29, 2011, 13 pages with English translation.

Notice of Allowance, Japanese Appln. No. 2008-531016, dated Mar. 18, 2011, 6 pages with English translation.

Office Action, Japanese Appln. No. 2008-531017, dated May 23, 2011, 8 pages with English translation.

Office Action, Japanese Appln. No. 2008-531018, dated May 24, 2011, 5 pages with English translation.

Faller and Baumgarte, "Efficient Representation of Spatial Audio Using Perceptual Parametrization," IEEE Workshop on Applications of Signal Processing to Audio and Acoustics 2001, Oct. 21-24, 2001, pp. 199-202.

Breebaart, et al., "MPEG Spatial Audio Coding/Mpeg Surround: Overview and Current Status", AES 119th Convention Paper, New York USA, Oct. 7-10, 2005.

Breebaart, et al.: •Multi-Channel Goes Mobile: MPEG Surround Binaural Rendering• In: Audio Engineering Society the 29th International Conference, Seoul, Sep. 2-4, 2006, pp. 1-13. See the abstract, pp. 1-4, figures 5,6.

Canadian Office Action for Application No. 2621664 dated Mar. 30, 2010, 2 pages.

(56) References Cited

OTHER PUBLICATIONS

Office Action, Japanese Application No. 2008-531016, mailed Apr. 26, 2010, 4 pages with English translation.
Faller, C., et al.: •Binaural Cue Coding—Part II: Schemes and Applications•, IEEE Transactions on Speech and Audio Processing, vol. 11, No. 6, 2003, 12 pages.
Faller, C.: •Coding of Spatial Audio Compatible with Different Playback Formats •, Audio Engineering Society Convention Paper, Presented at 117th Convention, Oct. 28-31, 2004, San Francisco, CA.
Faller, C.: Parametric Coding of Spatial Audio•, Proc. of the 7th Int. Conference on Digital Audio Effects, Naples, Italy, 2004, 6 pages.
Herre, J., et al.: •Spatial Audio Coding: Next generation efficient and compatible coding of multi-channel audio•, Audio Engineering Society Convention Paper, San Francisco, CA, 2004, 13 pages.
Herre, J., et al.: •The Reference Model Architecture for MPEG Spatial Audio Coding•, Audio Engineering Society Convention Paper 6447, 2005, Barcelona, Spain, 13 pages.
International Search Report in International Application No. PCT/KR2007/000345, dated Apr. 19, 2007, 1 page.
International Search Report in International Application No. PCT/KR2007-000346, dated Apr. 18, 2007, 1 page.
International Search Report in International Application No. PCT/KR2007/000347, Apr. 7, 2007, 1 page.
International Search Report in International Application No. PCT/KR2007/000866, dated Apr. 30, 2007, 1 page.
International Search Report in International Application No. PCT/KR2007/000867, dated Apr. 30, 2007, 1 page.
International Search Report in International Application No. PCT/KR2007/000868, dated Apr. 30, 2007, 1 page.
International Search Report in International Application No. PCT/KR2006/001987, dated Nov. 24, 2006, 2 pages.
International Search Report in International Application No. PCT/KR200S/002016, dated Oct. 1S, 2006, 2 pages.
International Search Report in International Application No. PCT/KR2006/003659, dated Jan. 9, 2007, 1 page.
International Search Report in International Application No. PCT/KR2006/003661, dated Jan. 11, 2007, 1 page, PCT/KR2006/003662.
International Search Report in International Application No. PCT/KR2007/000340, dated May 4, 2007, 1 page.
International Search Report in International Application No. PCT/KR2007/000668, dated Jun. 11, 2007, 2 pages.
International Search Report in International Application No. PCT/KR2007/000672, dated Jun. 11, 2007, 1 page.
International Search Report in International Application No. PCT/KR2007/000675, dated Jun. 8, 2007, 1 page.
International Search Report in International Application No. PCT/KR2007/000676, dated Jun. 8, 2007, 1 page.
International Search Report in International Application No. PCT/KR2007/000730, dated Jun. 12, 2007,1 page.
International Search Report in International Application No. PCT/KR2007/001560, dated Jul. 20, 2007,1 page.
International Search Report in International Application No. PCT/KR2007/001602, dated Jul. 23, 2007,1 page.
Japanese Notice of Allowance issued for Application No. 2008-531016 on Mar. 18, 2011.
Japanese Office Action dated Apr. 22, 2010 for Japanese Patent Application No. 2008-531015, 9 pages.
Korean Notice of Allowance for Application No. 10-2008-7005385, dated Aug. 25, 2008, 2 pages.
Non-Final Office Action for U.S. Appl. No. 12/066,642 dated Dec. 1, 2010, 29 pages.
Non-Final Office Action for U.S. Appl. No. 12/066,645 dated Apr. 5, 2010, 8 pages.
Non-Final Office Action for U.S. Appl. No. 12/066,651 dated Mar. 22, 2010.
Office Action. Mexican Patent Application No. MX/a/2008/003544, dated Aug. 2, 2010, 6 pages.
Pang, Hee-Suk, et al. "Extended pilot-based coding for lossless bit rate reduction of MPEG Surround." *ETRI Journal* 29.1 (Feb. 2007): 103-106.
Russian Notice of Allowance for Application No. 2008114388, dated Aug. 24, 2009, 13 pages.
Said, A. "On the Reduction of Entropy Coding Complexity Via Symbol Grouping: I-Redundancy Analysis and Optimal Alphabet Partition", HP Laboratories Palo Alto, HPL-2004-145, Aug. 23, 2004.
Scheirer, E. D., et al.: "AudioBIFS: Describing Audio Scenes with the MPEG-4 Multimedia Standard", IEEE Transactions on Multimedia, Sep. 1999, vol. 1, No. 3, pp. 237-250. See the abstract.
Taiwan Examiner, Taiwanese Office Action for Application No. 96104544, dated Oct. 9, 2009, 13 pages.
Taiwan Patent Office, Office Action in Taiwanese patent application 096102410, dated Jul. 2, 2009, 5 pages.
Vannanen, R., et al.: "Encoding and Rendering of Perceptual Sound Scenes in the Carrouso Project", AES 22nd International Conference on Virtual, Synthetic and Entertainment Audio, Paris, France, 9 pages.
Vannanen, Riitta, "User Interaction and Authoring of 3D Sound Scenes in the Carrouso EU project", Audio Engineering Society Convention Paper 5764, Amsterdam, The Netherlands, 2003, 9 pages.
U.S. Office Action in U.S. Appl. No. 13/012,641, dated May 22, 2014, 8 pages.
U.S. Final Office Action in U.S. Appl. No. 13/088,947, dated Aug. 7, 2014, 11 pages.
U.S. Office Action in U.S. Appl. No. 13/019,153, dated Apr. 15, 2016, 15 pages.
U.S. Office Action in U.S. Appl. No. 13/088,947, dated Dec. 18, 2015, 8 pages.

* cited by examiner

| Division identifier/ Non-division identifier : | (1) | (2) | (3) | (4) | (5) | (6) | (7) | (8) | (9) | (10) |
|---|---|---|---|---|---|---|---|---|---|---|
| | 0 | 1 | 0 | 0 | 0 | 1 | 0 | 0 | 0 | 0 |

METHOD AND APPARATUS FOR DECODING AN AUDIO SIGNAL

This application is a continuation of U.S. application Ser. No. 12/066,650, filed Mar. 12, 2008, which is a 371 National Phase application of PCT/KR2006/003662, filed Sep. 14, 2006, published as WO2007032648, which claims priority benefit of U.S. Provisional Application Ser. No. 61/716,524 filed Sep. 14, 2005, and also claims priority benefit of U.S. Provisional Application Ser. No. 60/759,980 filed Jan. 19, 2006, and also claims priority benefit of U.S. Provisional Application Ser. No. 60/760,360 filed Jan. 20, 2006, and also claims priority benefit of U.S. Provisional Application Ser. No. 60/773,669 filed Feb. 16, 2006, and also claims priority benefit of U.S. Provisional Application Ser. No. 60/776,724 filed Feb. 27, 2006, and also claims priority benefit of U.S. Provisional Application Ser. No. 60/787,516 filed Mar. 31, 2006, and also claims priority benefit of U.S. Provisional Application Ser. No. 60/816,022 filed Jun. 22, 2006, and also claims foreign priority benefit of Korean Patent application Ser. No. 10-2006-0078300 filed Aug. 18, 2006.

TECHNICAL FIELD

The present invention relates to audio signal processing, and more particularly, to an apparatus for decoding an audio signal and method thereof. Although the present invention is suitable for a wide scope of applications, it is particularly suitable for decoding audio signals.

BACKGROUND ART

Generally, when an encoder encodes an audio signal, in case that the audio signal to be encoded is a multi-channel audio signal, the multi-channel audio signal is downmixed into two channels or one channel to generate a downmix audio signal and spatial information is extracted from the multi-channel audio signal. The spatial information is the information usable in upmixing the multi-channel audio signal from the downmix audio signal. Meanwhile, the encoder downmixes a multi-channel audio signal according to a predetermined tree configuration. In this case, the predetermined tree configuration can be the structure(s) agreed between an audio signal decoder and an audio signal encoder. In particular, if identification information indicating a type of one of the predetermined tree configurations is present, the decoder is able to know a structure of the audio signal having been upmixed, e.g., a number of channels, a position of each of the channels, etc.

Thus, if an encoder downmixes a multi-channel audio signal according to a predetermined tree configuration, spatial information extracted in this process is dependent on the structure as well. So, in case that a decoder upmixes the downmix audio signal using the spatial information dependent on the structure, a multi-channel audio signal according to the structure is generated. Namely, in case that the decoder uses the spatial information generated by the encoder as it is, upmixing is performed according to the structure agreed between the encoder and the decoder only. So, it is unable to generate an output-channel audio signal failing to follow the agreed structure. For instance, it is unable to upmix a signal into an audio signal having a channel number different (smaller or greater) from a number of channels decided according to the agreed structure.

DISCLOSURE OF THE INVENTION

Accordingly, the present invention is directed to an apparatus for decoding an audio signal and method thereof that substantially obviate one or more of the problems due to limitations and disadvantages of the related art.

An object of the present invention is to provide an apparatus for decoding an audio signal and method thereof, by which the audio signal can be decoded to have a structure different from that decided by an encoder.

Another object of the present invention is to provide an apparatus for decoding an audio signal and method thereof, by which the audio signal can be decoded using spatial information generated from modifying former spatial information generated from encoding.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method of decoding an audio signal according to the present invention includes receiving the audio signal and spatial information, identifying a type of modified spatial information, generating the modified spatial information using the spatial information, and decoding the audio signal using the modified spatial information, wherein the type of the modified spatial information includes at least one of partial spatial information, combined spatial information and expanded spatial information.

To further achieve these and other advantages and in accordance with the purpose of the present invention, a method of decoding an audio signal includes receiving spatial information, generating combined spatial information using the spatial information, and decoding the audio signal using the combined spatial information, wherein the combined spatial information is generated by combining spatial parameters included in the spatial information.

To further achieve these and other advantages and in accordance with the purpose of the present invention, a method of decoding an audio signal includes receiving spatial information including at least one spatial information and spatial filter information including at least one filter parameter, generating combined spatial information having a surround effect by combining the spatial parameter and the filter parameter, and converting the audio signal to a virtual surround signal using the combined spatial information.

To further achieve these and other advantages and in accordance with the purpose of the present invention, a method of decoding an audio signal includes receiving the audio signal, receiving spatial information including tree configuration information and spatial parameters, generating modified spatial information by adding extended spatial information to the spatial information, and upmixing the audio signal using the modified spatial information, which comprises including converting the audio signal to a primary upmixed audio signal based on the spatial information and converting the primary upmixed audio signal to a secondary upmixed audio signal based on the extended spatial information.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

General terminologies used currently and globally are selected as terminologies used in the present invention. And, there are terminologies arbitrarily selected by the applicant for special cases, for which detailed meanings are explained in detail in the description of the preferred embodiments of the present invention. Hence, the present invention should be understood not with the names of the terminologies but with the meanings of the terminologies.

First of all, the present invention generates modified spatial information using spatial information and then decodes an audio signal using the generated modified spatial information. In this case, the spatial information is spatial information extracted in the course of downmixing according to a predetermined tree configuration and the modified spatial information is spatial information newly generated using spatial information.

The present invention will be explained in detail with reference to FIG. 1 as follows.

Figure 1:
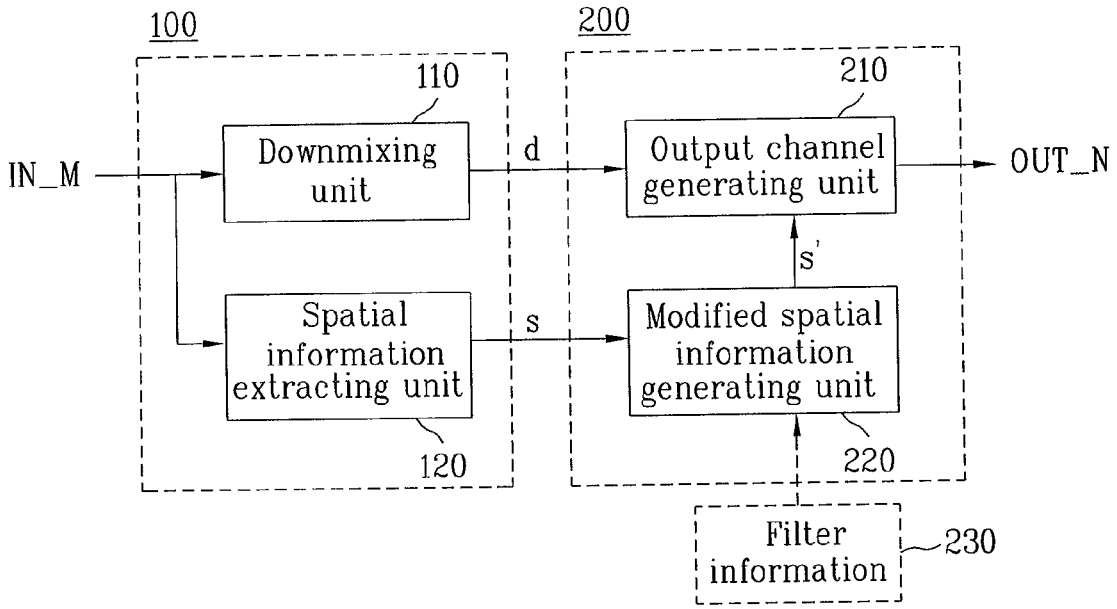
FIG. 1 is a block diagram of an audio signal encoding apparatus and an audio signal decoding apparatus according to the present invention.

FIG. 1 is a block diagram of an audio signal encoding apparatus and an audio signal decoding apparatus according to an embodiment of the present invention.

Referring to FIG. 1, an apparatus for encoding an audio signal (hereinafter abbreviated an encoding apparatus) 100 includes a downmixing unit 110 and a spatial information extracting unit 120. And, an apparatus for decoding an audio signal (hereinafter abbreviated a decoding apparatus) 200 includes an output channel generating unit 210 and a modified spatial information generating unit 220.

The downmixing unit 110 of the encoding apparatus 100 generates a downmix audio signal d by downmixing a multi-channel audio signal IN_M. The downmix audio signal d can be a signal generated from downmixing the multi-channel audio signal IN_M by the downmixing unit 110 or an arbitrary downmix audio signal generated from downmixing the multi-channel audio signal IN_M arbitrarily by a user.

The spatial information extracting unit 120 of the encoding apparatus 100 extracts spatial information s from the multi-channel audio signal IN_M. In this case, the spatial information is the information needed to upmix the downmix audio signal d into the multi-channel audio signal IN_M.

Meanwhile, the spatial information can be the information extracted in the course of downmixing the multi-channel audio signal IN_M according to a predetermined tree configuration. In this case, the tree configuration may correspond to tree configuration(s) agreed between the audio signal decoding and encoding apparatuses, which is not limited by the present invention.

And, the spatial information is able to include tree configuration information, an indicator, spatial parameters and the like. The tree configuration information is the information for a tree configuration type. So, a number of multi-channels, a per-channel downmixing sequence and the like vary according to the tree configuration type. The indicator is the information indicating whether extended spatial information is present or not, etc. And, the spatial parameters can include channel level difference (hereinafter abbreviated CLD) in the course of downmixing at least two channels into at most two channels, inter-channel correlation or coherence (hereinafter abbreviated ICC), channel prediction coefficients (hereinafter abbreviated CPC) and the like.

Meanwhile, the spatial information extracting unit 120 is able to further extract extended spatial information as well as the spatial information. In this case, the extended spatial information is the information needed to additionally extend the downmix audio signal d having been upmixed with the spatial parameter. And, the extended spatial information can include extended channel configuration information and extended spatial parameters. The extended spatial information, which shall be explained later, is not limited to the one extracted by the spatial information extracting unit 120.

Besides, the encoding apparatus 100 is able to further include a core codec encoding unit (not shown in the drawing) generating a downmixed audio bitstream by decoding the downmix audio signal d, a spatial information encoding unit (not shown in the drawing) generating a spatial information bitstream by encoding the spatial information s, and a multiplexing unit (not shown in the drawing) generating a bitstream of an audio signal by multiplexing the downmixed audio bitstream and the spatial information bitstream, on which the present invention does not put limitation.

And, the decoding apparatus 200 is able to further include a demultiplexing unit (not shown in the drawing) separating the bitstream of the audio signal into a downmixed audio bitstream and a spatial information bitstream, a core codec decoding unit (not shown in the drawing) decoding the downmixed audio bitstream, and a spatial information decoding unit (not shown in the drawing) decoding the spatial information bitstream, on which the present invention does not put limitation.

The modified spatial information generating unit 220 of the decoding apparatus 200 identifies a type of the modified spatial information using the spatial information and then generates modified spatial information s' of a type that is identified based on the spatial information. In this case, the spatial information can be the spatial information s conveyed from the encoding apparatus 100. And, the modified spatial information is the information that is newly generated using the spatial information.

Meanwhile, there can exist various types of the modified spatial information. And, the various types of the modified spatial information can include at least one of a) partial spatial information, b) combined spatial information, and c) extended spatial information, on which no limitation is put by the present invention.

The partial spatial information includes spatial parameters in part, the combined spatial information is generated from combining spatial parameters, and the extended spatial information is generated using the spatial information and the extended spatial information.

The modified spatial information generating unit 220 generates the modified spatial information in a manner that can be varied according to the type of the modified spatial information. And, a method of generating modified spatial information per a type of the modified spatial information will be explained in detail later.

Meanwhile, a reference for deciding the type of the modified spatial information may correspond to tree configuration information in spatial information, indicator in spatial information, output channel information or the like. The tree configuration information and the indicator can be included in the spatial information s from the encoding apparatus. The output channel information is the information for speakers interconnecting to the decoding apparatus 200 and can include a number of output channels, position information for each output channel and the like. The output channel information can be inputted in advance by a manufacturer or inputted by a user.

A method of deciding a type of modified spatial information using theses infomations will be explained in detail later.

The output channel generating unit 210 of the decoding apparatus 200 generates an output channel audio signal OUT_N from the downmix audio signal d using the modified spatial information s'.

The spatial filter information 230 is the information for sound paths and is provided to the modified spatial information generating unit 220. In case that the modified spatial information generating unit 220 generates combined spatial information having a surround effect, the spatial filter information can be used.

Hereinafter, a method of decoding an audio signal by generating modified spatial information per a type of the modified spatial information is explained in order of (1) Partial spatial information, (2) Combined spatial information, and (3) Expanded spatial information as follows.

(1) Partial Spatial Information

Since spatial parameters are calculated in the course of downmixing a multi-channel audio signal according to a predetermined tree configuration, an original multi-channel audio signal before downmixing can be reconstructed if a downmix audio signal is decoded using the spatial parameters intact. In case of attempting to make a channel number N of an output channel audio signal be smaller than a channel number M of a multi-channel audio signal, it is able to decode a downmix audio signal by applying the spatial parameters in part.

This method can be varied according to a sequence and method of downmixing a multi-channel audio signal in an encoding apparatus, i.e., a type of a tree configuration. And, the tree configuration type can be inquired using tree configuration information of spatial information. And, this method can be varied according to a number of output channels. Moreover, it is able to inquire the number of output channels using output channel information.

Hereinafter, in case that a channel number of an output channel audio signal is smaller than a channel number of a multi-channel audio signal, a method of decoding an audio signal by applying partial spatial information including spatial parameters in part is explained by taking various tree configurations as examples in the following description.

(1)-1. First Example of Tree Configuration (5-2-5 Tree Configuration)

Figure 2:
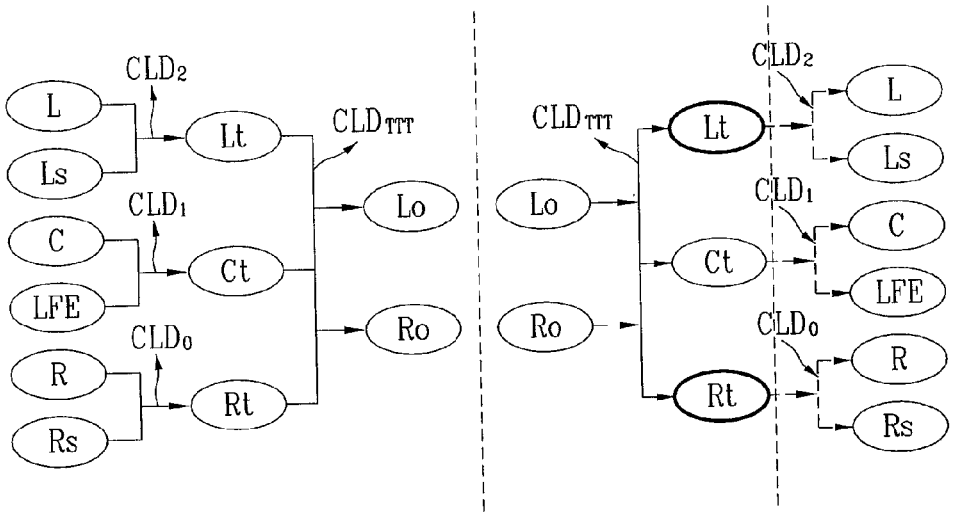
FIG. 2 is a schematic diagram of an example of applying partial spatial information.

FIG. 2 is a schematic diagram of an example of applying partial spatial information.

Referring to a left part of FIG. 2, a sequence of downmixing a multi-channel audio signal having a channel number 6 (left front channel L, left surround channel $L_s$, center channel C, low frequency channel LFE, right front channel R, right surround channel $R_s$) into stereo downmixed channels $L_o$ and $R_o$ and the relation between the multi-channel audio signal and spatial parameters are shown.

First of all, downmixing between the left channel L and the left surround channel $L_s$, downmixing between the center channel C and the low frequency channel LFE and downmixing between the right channel R and the right surround channel $R_s$ are carried out. In this primary downmixing process, a left total channel $L_t$, a center total channel $C_t$ and a right total channel $R_t$ are generated. And, spatial parameters calculated in this primary downmixing process include $CLD_2$ ($ICC_2$ inclusive), $CLD_1$ ($ICC_1$ inclusive), $CLD_0$ ($ICC_0$ inclusive), etc.

In a secondary process following the primary downmixing process, the left total channel $L_t$, the center total channel $C_t$ and the right total channel $R_t$ are downmixed together to generate a left channel $L_o$ and a right channel $R_o$. And, spatial parameters calculated in this secondary downmixing process are able to include $CLD_{TTT}$, $CPC_{TTT}$, $ICC_{TTT}$, etc.

In other words, a multi-channel audio signal of total six channels is downmixed in the above sequential manner to generate the stereo downmixed channels $L_o$ and $R_o$.

If the spatial parameters ($CLD_2$, $CLD_1$, $CLD_0$, $CLD_{TTT}$, etc.) calculated in the above sequential manner are used as they are, they are upmixed in sequence reverse to the order for the downmixing to generate the multi-channel audio signal having the channel number of 6 (left front channel L, left surround channel $L_s$, center channel C, low frequency channel LFE, right front channel R, right surround channel $R_s$).

Referring to a right part of FIG. 2, in case that partial spatial information corresponds to $CLD_{TTT}$ among spatial parameters ($CLD_2$, $CLD_1$, $CLD_0$, $CLD_{TTT}$, etc.), it is upmixed into the left total channel $L_t$, the center total channel $C_t$ and the right total channel $R_t$. If the left total channel $L_t$ and the right total channel $R_t$ are selected as an output channel audio signal, it is able to generate an output channel audio signal of two channels $L_t$ and $R_t$. If the left total channel $L_t$, the center total channel $C_t$ and the right total channel $R_t$ are selected as an output channel audio signal, it is able to generate an output channel audio signal of three channels $L_t$, $C_t$ and $R_t$. After upmixing has been performed using $CLD_1$ in addition, if the left total channel $L_t$, the right total channel $R_t$, the center channel C and the low frequency channel LFE are selected, it is able to generate an output channel audio signal of four channels ($L_t$, $R_t$, C and LFE).

(1)-2. Second Example of Tree Configuration (5-1-5 Tree Configuration)

Figure 3:
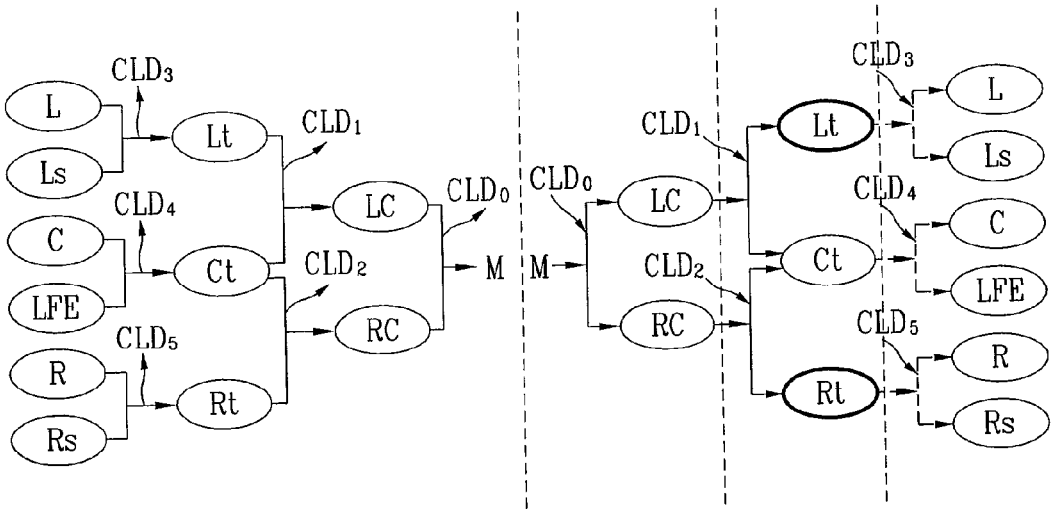
FIG. 3 is a schematic diagram of another example of applying partial spatial information.

FIG. 3 is a schematic diagram of another example of applying partial spatial information.

Referring to a left part of FIG. 3, a sequence of downmixing a multi-channel audio signal having a channel number 6 (left front channel L, left surround channel $L_s$, center channel C, low frequency channel LFE, right front channel R, right surround channel $R_s$) into a mono downmix audio signal M and the relation between the multi-channel audio signal and spatial parameters are shown.

First of all, like the first example, downmixing between the left channel L and the left surround channel $L_s$, downmixing between the center channel C and the low frequency channel LFE and downmixing between the right channel R and the right surround channel $R_s$ are carried out. In this primary downmixing process, a left total channel $L_t$, a center total channel $C_t$ and a right total channel $R_t$ are generated. And, spatial parameters calculated in this primary downmixing process include $CLD_3$ ($ICC_3$ inclusive), $CLD_4$ ($ICC_4$ inclusive), $CLD_5$ ($ICC_5$ inclusive), etc. (in this case, $CLD_x$ and $ICC_x$ are discriminated from the former $CLD_x$ in the first example).

In a secondary process following the primary downmixing process, the left total channel $L_t$ and the right total channel $R_t$ are downmixed together to generate a left center channel LC, and the center total channel $C_t$ and the right total channel $R_t$ are downmixed together to generate a right center channel RC. And, spatial parameters calculated in this secondary downmixing process are able to include $CLD_2$ ($ICC_2$ inclusive), $CLD_1$ ($ICC_1$ inclusive), etc.

Subsequently, in a tertiary downmixing process, the left center channel LC and the right center channel $R_t$ are downmixed to generate a mono downmixed signal M. And, spatial parameters calculated in the tertiary downmxing process include $CLD_0$ ($ICC_0$ inclusive), etc.

Referring to a right part of FIG. 3, in case that partial spatial information corresponds to $CLD_0$ among spatial parameters ($CLD_3$, $CLD_4$, $CLD_5$, $CLD_1$, $CLD_2$, $CLD_0$, etc.), a left center channel LC and a right center channel RC are generated. If the left center channel LC and the right center channel RC are selected as an output channel audio signal, it is able to generate an output channel audio signal of two channels LC and RC.

Meanwhile, if partial spatial information corresponds to $CLD_0$, $CLD_1$ and $CLD_2$, among spatial parameters ($CLD_3$, $CLD_4$, $CLD_5$, $CLD_1$, $CLD_2$, $CLD_0$, etc.), a left total channel $L_t$, a center total channel $C_t$ and a right total channel $R_t$ are generated.

If the left total channel $L_t$ and the right total channel $R_t$ are selected as an output channel audio signal, it is able to generate an output channel audio signal of two channels $L_t$ and $R_t$. If the left total channel $L_t$, the center total channel $C_t$ and the right total channel $R_t$ are selected as an output channel audio signal, it is able to generate an output channel audio signal of three channels $L_t$, $C_t$ and $R_t$.

In case that partial spatial information includes $CLD_4$ in addition, after upmixing has been performed up to a center channel and a low frequency channel LFE, if the left total channel $L_t$, the right total channel $R_t$, the center channel C and the low frequency channel LFE are selected as an output channel audio signal, it is able to generate an output channel audio signal of four channels ($L_t$, $R_t$, C and LFE).

(1)-3. Third Example of Tree Configuration (5-1-5 Tree Configuration)

Figure 4:
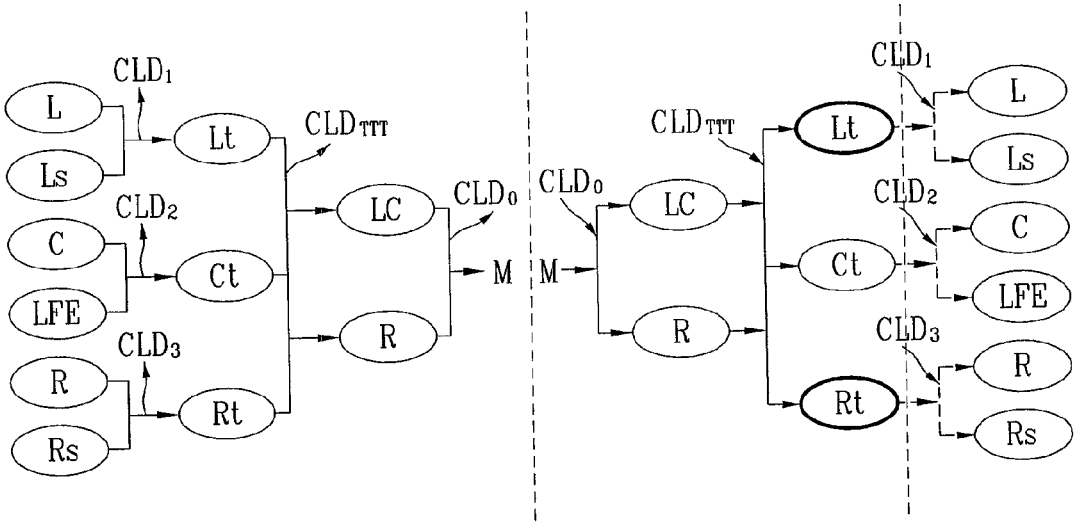
FIG. 4 is a schematic diagram of a further example of applying partial spatial information.

FIG. 4 is a schematic diagram of a further example of applying partial spatial information.

Referring to a left part of FIG. 4, a sequence of downmixing a multi-channel audio signal having a channel number 6 (left front channel L, left surround channel $L_s$, center channel C, low frequency channel LFE, right front channel R, right surround channel $R_s$) into a mono downmix audio signal M and the relation between the multi-channel audio signal and spatial parameters are shown.

First of all, like the first or second example, downmixing between the left channel L and the left surround channel $L_s$, downmixing between the center channel C and the low frequency channel LFE and downmixing between the right channel R and the right surround channel $R_s$ are carried out. In this primary downmixing process, a left total channel $L_t$, a center total channel $C_t$ and a right total channel $R_t$ are generated. And, spatial parameters calculated in this primary downmixing process include $CLD_1$ ($ICC_1$ inclusive), $CLD_2$ ($ICC_2$ inclusive), $CLD_3$ ($ICC_3$ inclusive), etc. (in this case, $CLD_x$ and $ICC_x$ are discriminated from the former $CLD_x$ and $ICC_x$ in the first or second example).

In a secondary process following the primary downmixing process, the left total channel $L_t$, the center total channel $C_t$ and the right total channel $R_t$ are downmixed together to generate a left center channel LC and a right channel R. And, a spatial parameter $CLD_{TTT}$ ($ICC_{TTT}$ inclusive) is calculated.

Subsequently, in a tertiary downmixing process, the left center channel LC and the right channel R are downmixed to generate a mono downmixed signal M. And, a spatial parameter $CLD_0$ ($ICC_0$ inclusive) is calculated.

Referring to a right part of FIG. 4, in case that partial spatial information corresponds to $CLD_0$ and $CLD_{TTT}$ among spatial parameters ($CLD_1$, $CLD_2$, $CLD_3$, $CLD_{TTT}$, $CLD_0$, etc.), a left total channel $L_t$, a center total channel $C_t$ and a right total channel $R_t$ are generated.

If the left total channel $L_t$ and the right total channel $R_t$ are selected as an output channel audio signal, it is able to generate an output channel audio signal of two channels $L_t$ and $R_t$.

If the left total channel $L_t$, the center total channel $C_t$ and the right total channel $R_t$ are selected as an output channel audio signal, it is able to generate an output channel audio signal of three channels $L_t$, $C_t$ and $R_t$.

In case that partial spatial information includes $CLD_2$ in addition, after upmixing has been performed up to a center channel C and a low frequency channel LFE, if the left total channel $L_t$, the right total channel $R_t$, the center channel C and the low frequency channel LFE are selected as an output channel audio signal, it is able to generate an output channel audio signal of four channels ($L_t$, $R_t$, C and LFE).

In the above description, the process for generating the output channel audio signal by applying the spatial parameters in part only has been explained by taking the three kinds of tree configurations as examples. Besides, it is also able to additionally apply combined spatial information or extended spatial information as well as the partial spatial information. Thus, it is able to handle the process for applying the modified spatial information to the audio signal hierarchically or collectively and synthetically.

(2) Combined Spatial Information

Since spatial information is calculated in the course of downmixing a multi-channel audio signal according to a predetermined tree configuration, an original multi-channel audio signal before downmixing can be reconstructed if a downmix audio signal is decoded using spatial parameters of the spatial information as they are. In case that a channel number M of a multi-channel audio signal is different from a channel number N of an output channel audio signal, new combined spatial information is generated by combining spatial information and it is then able to upmix the downmix audio signal using the generated information. In particular, by applying spatial parameters to a conversion formula, it is able to generate combined spatial parameters.

This method can be varied according to a sequence and method of downmixing a multi-channel audio signal in an encoding apparatus. And, it is able to inquire the downmixing sequence and method using tree configuration information of spatial information. And, this method can be varied according to a number of output channels. Moreover, it is able to inquire the number of output channels and the like using output channel information.

Hereinafter, detailed embodiments for a method of modifying spatial information and embodiments for giving a virtual 3-D effect are explained in the following description.

(2)-1. General Combined Spatial Information

A method of generating combined spatial parameters by combining spatial parameters of spatial information is provided for the upmixing according to a tree configuration different from that in a downmixing process. So, this method is applicable to all kinds of downmix audio signals no matter what a tree configuration according to tree configuration information is.

In case that a multi-channel audio signal is 5.1-channel and a downmix audio signal is 1-channel (mono channel), a method of generating an output channel audio signal of two channels is explained with reference to two kinds of examples as follows.

(2)-1-1. Fourth Embodiment of Tree Configuration (5-1-$5_1$ Tree Configuration)

Figure 5:
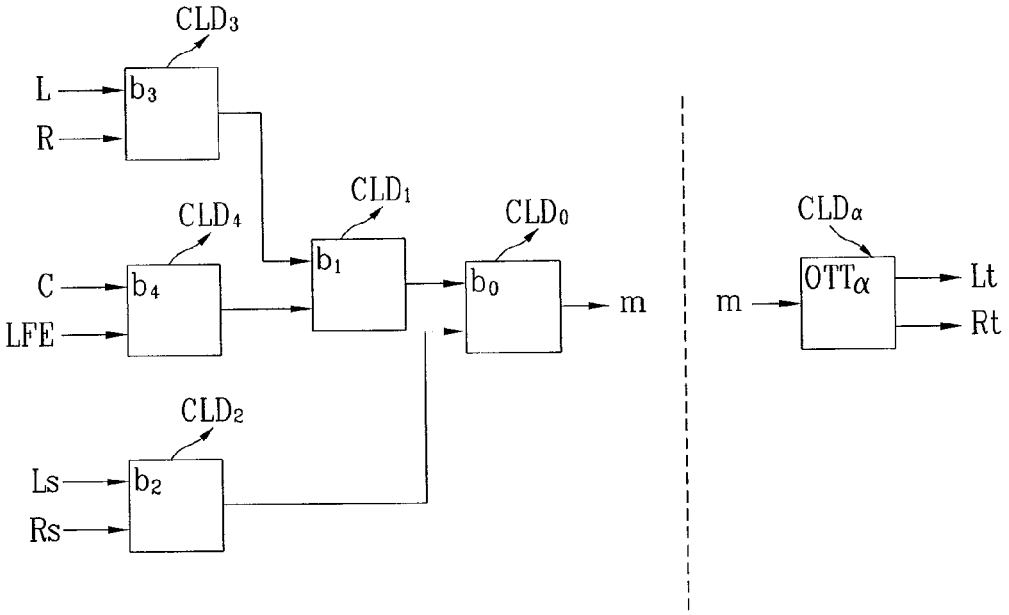
FIG. 5 is a schematic diagram of an example of applying combined spatial information.

FIG. 5 is a schematic diagram of an example of applying combined spatial information.

Referring to a left part of FIG. 5, $CLD_0$ to $CLD_4$ and $ICC_0$ to $ICC_4$ (not shown in the drawing) can be called spatial parameters that can be calculated in a process for downmixing a multi-channel audio signal of 5.1-channels. For instance, in spatial parameters, an inter-channel level difference between a left channel signal L and a right channel signal R is $CLD_3$ and inter-channel correlation between L and R is $ICC_3$. And, an inter-channel level difference between a left surround channel $L_s$ and a right surround channel $R_s$ is $CLD_2$ and inter-channel correlation between $L_s$ and $R_s$ is $ICO_2$.

On the other hand, referring to a right part of FIG. 5, if a left channel signal $L_t$ and a right channel signal $R_t$ are generated by applying combined spatial parameters $CLD_\alpha$ and $ICC_\alpha$ to a mono downmix audio signal m, it is able to directly generate a stereo output channel audio signal $L_t$ and $R_t$ from the mono channel audio signal m. In this case, the combined spatial parameters $CLD_\alpha$ and $ICC_\alpha$ can be calculated by combining the spatial parameters $CLD_0$ to $CLD_4$ and $ICC_0$ to $ICC_4$.

Hereinafter, a process for calculating $CLD_\alpha$ among combined spatial parameters by combining $CLD_0$ to $CLD_4$ together is firstly explained, and a process for calculating $ICC_\alpha$ among combined spatial parameters by combining $CLD_0$ to $CLD_4$ and $ICC_0$ to $ICC_4$ is then explained as follows.

(2)-1-1-a. Derivation of $CLD_\alpha$

First of all, since $CLD_\alpha$ is a level difference between a left output signal $L_t$ and a right output signal $R_t$, a result from inputting the left output signal $L_t$ and the right output signal $R_t$ to a definition formula of CLD is shown as follows.

$$CLD_\alpha=10*\log_{10}(P_{Lt}/P_{Rt}), \quad \text{[Formula 1]}$$

where $P_{Lt}$ is a power of $L_t$ and $P_{Rt}$ is a power of $R_t$.

$$CLD_\alpha=10*\log_{10}(P_{Lt}+a/P_{Rt}+a), \quad \text{[Formula 2]}$$

where $P_{Lt}$ is a power of $L_t$, $P_{Rt}$ is a power of $R_t$, and 'a' is a very small constant.

Hence, $CLD_\alpha$ is defined as Formula 1 or Formula 2.

Meanwhile, in order to represent $P_{Lt}$ and $P_{Rt}$ using spatial parameters $CLD_0$ to $CLD_4$, a relation formula between a left output signal $L_t$ of an output channel audio signal, a right output signal $R_t$ of the output channel audio signal and a multi-channel signal L, $L_s$, R, $R_s$, C and LFE are needed. And, the corresponding relation fomula can be defined as follows.

$$L_t=L+L_s+C/\sqrt{2}+\mathrm{LFE}/\sqrt{2}$$

$$R_t=R+R_s+C/\sqrt{2}+\mathrm{LFE}/\sqrt{2} \quad \text{[Formula 3]}$$

Since the relation formula like Formula 3 can be varied according to how to define an output channel audio signal, it can be defined in a manner of formula different from Formula 3. For instance, '$1/\sqrt{2}$' in $C/\sqrt{2}$ or $\mathrm{LFE}/\sqrt{2}$ can be '0' or '1'.

Formula 3 can bring out Formula 4 as follows.

$$P_{Lt}=P_L+P_{Ls}+P_c/2+P_{LFE}/2$$

$$P_{Rt}=P_R+P_{Rs}+P_c/2+P_{LFE}/2 \quad \text{[Formula 4]}$$

It is able to represent $CLD_\alpha$ according to Formula 1 or Formula 2 using $P_{Lt}$ and $P_{Rt}$. And, '$P_{Lt}$ and $P_{Rt}$' can be represented according to Formula 4 using $P_L$, $P_{Ls}$, $P_c$, $P_{LFE}$, $P_R$ and $P_{Rs}$. So, it is needed to find a relation formula enabling the $P_L$, $P_{Ls}$, $P_c$, $P_{LFE}$, $P_R$ and $P_{Rs}$ to be represented using spatial parameters $CLD_0$ to $CLD_4$.

Meanwhile, in case of the tree configuration shown in FIG. 5, a relation between a multi-channel audio signal (L, R, C, LFE, $L_s$, $R_s$) and a mono downmixed channel signal m is shown as follows.

$$\begin{bmatrix} L \\ R \\ C \\ LFE \\ Ls \\ Rs \end{bmatrix} = \begin{bmatrix} D_L \\ D_R \\ D_C \\ D_{LFE} \\ D_{Ls} \\ D_{Rs} \end{bmatrix} m = \begin{bmatrix} c_{1,OTT3}c_{1,OTT1}c_{1,OTT0} \\ c_{2,OTT3}c_{1,OTT1}c_{1,OTT0} \\ c_{1,OTT4}c_{2,OTT1}c_{1,OTT0} \\ c_{2,OTT4}c_{2,OTT1}c_{1,OTT0} \\ c_{1,OTT2}c_{2,OTT0} \\ c_{2,OTT2}c_{2,OTT0} \end{bmatrix} m \quad \text{\{Formula 5\}}$$

where, $$c_{1,OTT_x} = \sqrt{\frac{10^{\frac{CLD_x}{10}}}{1+10^{\frac{CLD_x}{10}}}},$$

$$c_{2,OTT_x} = \sqrt{\frac{1}{1+10^{\frac{CLD_x}{10}}}}.$$

And, Formula 5 brings about Formula 6 as follows.

$$\begin{bmatrix} P_L \\ P_R \\ P_C \\ P_{LFE} \\ P_{Ls} \\ P_{Rs} \end{bmatrix} = \begin{bmatrix} (c_{1,OTT3}c_{1,OTT1}c_{1,OTT0})^2 \\ (c_{2,OTT3}c_{1,OTT1}c_{1,OTT0})^2 \\ (c_{1,OTT4}c_{2,OTT1}c_{1,OTT0})^2 \\ (c_{2,OTT4}c_{2,OTT1}c_{1,OTT0})^2 \\ (c_{1,OTT2}c_{2,OTT0})^2 \\ (c_{2,OTT2}c_{2,OTT0})^2 \end{bmatrix} m^2 \quad \text{[Formula 6]}$$

where,

-continued $$c_{1,OTT_x} = \sqrt{\frac{10^{\frac{CLD_x}{10}}}{1+10^{\frac{CLD_x}{10}}}},$$

$$c_{2,OTT_x} = \sqrt{\frac{1}{1+10^{\frac{CLD_x}{10}}}}.$$

In particular, by inputting Formula 6 to Formula 4 and by inputting Formula 4 to Formula 1 or Formula 2, it is able to represent the combined spatial parameter $CLD_\alpha$ in a manner of combining spatial parameters $CLD_0$ to $CLD_4$.

Meanwhile, an expansion resulting from inputting Formula 6 to $P_c/2+P_{LFE}/2$ in Formula 4 is shown in Formula 7.

$$P_c/2+P_{LFE}/2=[(c_{1,OTT4})^2+(c_{2,OTT4})^2]*(c_{2,OTT1}*c_{1,OTT0})^2*m^2/2, \quad \text{[Formula 7]}$$

In this case, according to definitions of $c_1$ and $c_2$ (cf. Formula 5), since $(c_{1,x})^2+(c_{2,x})^2=1$, it results in $(c_{1,OTT4})^2+(c_{2,OTT4})^2=1$.

So, Formula 7 can be briefly summarized as follows.

$$P_c/2+P_{LFE}/2=(c_{2,OTT1}*c_{1,OTT0})^2*/m^2/2 \quad \text{[Formula 8]}$$

Therefore, by inputting Formula 8 and Formula 6 to Formula 4 and by inputting Formula 4 to Formula 1, it is able to represent the combined spatial parameter $CLD_\alpha$ in a manner of combining spatial parameters $CLD_0$ to $CLD_4$.

(2)-1-1-b. Derivation of $ICC_\alpha$

First of all, since $ICC_\alpha$ is a correlation between a left output signal $L_t$ and a right output signal $R_t$, a result from inputting the left output signal $L_t$ and the right output signal $R_t$ to a corresponding definition formula is shown as follows.

$$ICC_\alpha = \frac{P_{LtRt}}{\sqrt{P_{Lt}P_{Rt}}}, \text{ where} \quad \text{[Formula 9]}$$

$$P_{x_1x_2} = \sum x_1x_2^*.$$

In Formula 9, $P_{Lt}$ and $P_{Rt}$ can be represented using $CLD_0$ to $CLD_4$ in Formula 4, Formula 6 and Formula 8. And, $P_{Lt}P_{Rt}$ can be expanded in a manner of Formula 10.

$$P_{LtRt}=P_{LR}+P_{LsRs}+P_c/2+P_{LFE}/2 \quad \text{[Formula 10]}$$

In Formula 10, '$P_c/2+P_{LFE}/2$' can be represented as $CLD_0$ to $CLD_4$ according to Formula 6. And, $P_{LR}$ and $P_{LsRs}$ can be expanded according to ICC definition as follows.

$$ICC_3=P_{LR}/\sqrt{(P_LP_R)}$$

$$ICC_2=P_{LsRs}/\sqrt{(P_{Ls}P_{Rs})} \quad \text{[Formula 11]}$$

In Formula 11, if $\sqrt{(P_LP_R)}$ or $\sqrt{(P_{Ls}P_{Rs})}$ is transposed, Formula 12 is obtained.

$$P_{LR}=ICC_3*\sqrt{(P_LP_R)}$$

$$P_{LsRs}=ICC_2*\sqrt{(P_{Ls}P_{Rs})} \quad \text{[Formula 12]}$$

In Formula 12, $P_L$, $P_R$, $P_{Ls}$ and $P_{Rs}$ can be represented as $CLD_0$ to $CLD_4$ according to Formula 6. A formula resulting from inputting Formula 6 to Formula 12 corresponds to Formula 13.

$$P_{LR}=ICC_3*c_{1,OTT3}*c_{2,OTT3}*(c_{1,OTT1}*c_{1,OTT0})^2*m^2$$

$$P_{LsRs}=ICC_2*c_{1,OTT2}*c_{2,OTT2}*(c_{2,OTT0})^2*m^2 \quad \text{[Formula 13]}$$

In summary, by inputting Formula 6 and Formula 13 to Formula 10 and by inputting Formula 10 and Formula 4 to Formula 9, it is able to represent a combined spatial parameter $ICC_\alpha$ as spatial parameters $CLD_0$ to $CLD_3$, $ICC_2$ and $ICC_3$.

(2)-1-2. Fifth Embodiment of Tree Configuration ($5\text{-}1\text{-}5_2$ Tree Configuration)

Figure 6:
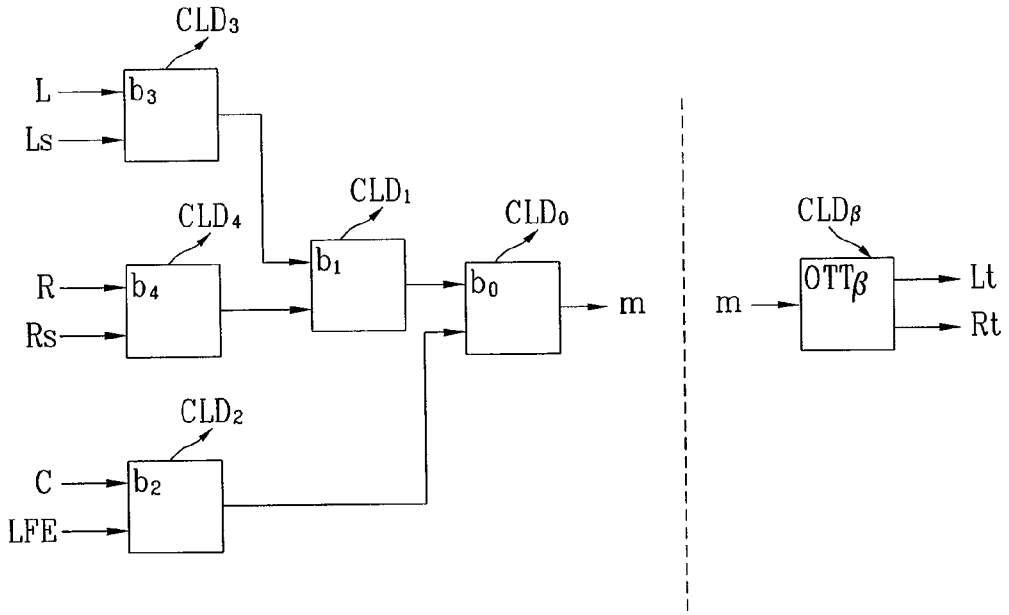
FIG. 6 is a schematic diagram of another example of applying combined spatial information.

FIG. 6 is a schematic diagram of another example of applying combined spatial information.

Referring to a left part of FIG. 6, $CLD_0$ to $CLD_4$ and $ICC_0$ to $ICC_4$ (not shown in the drawing) can be called spatial parameters that can be calculated in a process for downmixing a multi-channel audio signal of 5.1-channels.

In the spatial parameters, an inter-channel level difference between a left channel signal L and a left surround channel signal Ls is $CLD_3$ and inter-channel correlation between L and $L_s$ is $ICC_3$. And, an inter-channel level difference between a right channel R and a right surround channel $R_s$ is $CLD_4$ and inter-channel correlation between R and $R_s$ is $ICC_4$.

On the other hand, referring to a right part of FIG. 6, if a left channel signal $L_t$ and a right channel signal $R_t$ are generated by applying combined spatial parameters $CLD_\beta$ and $ICC_\beta$ to a mono downmix audio signal m, it is able to directly generate a stereo output channel audio signal $L_t$ and $R_t$ from the mono channel audio signal m. In this case, the combined spatial parameters $CLD_\beta$ and $ICC_\beta$ can be calculated by combining the spatial parameters $CLD_0$ to $CLD_4$ and $ICC_0$ to $ICC_4$.

Hereinafter, a process for calculating $CLD_\beta$ among combined spatial parameters by combining $CLD_0$ to $CLD_4$ is firstly explained, and a process for calculating $ICC_\beta$ among combined spatial parameters by combining $CLD_0$ to $CLD_4$ and $ICC_0$ to $ICC_4$ is then explained as follows.

(2)-1-2-a. Derivation of $CLD_\beta$

First of all, since $CLD_\beta$ is a level difference between a left output signal $L_t$ and a right output signal $R_t$, a result from inputting the left output signal $L_t$ and the right output signal $R_t$ to a definition formula of CLD is shown as follows.

$$CLD_\beta=10*\log_{10}(P_{Lt}/P_{Rt}) \quad \text{[Formula 14]}$$

where $P_{Lt}$ is a power of $L_t$ and $P_{Rt}$ is a power of $R_t$.

$$CLD_\beta=10*\log_{10}(P_{Lt}+a/P_{Rt}+a) \quad \text{[Formula 15]}$$

where $P_{Lt}$ is a power of $L_t$, $P_{Rt}$ is a power of $R_t$, and 'a' is a very small number.

Hence, $CLD_\beta$ is defined as Formula 14 or Formula 15.

Meanwhile, in order to represent $P_{Lt}$ and $P_{Rt}$ using spatial parameters $CLD_0$ to $CLD_4$, a relation formula between a left output signal $L_t$ of an output channel audio signal, a right output signal $R_t$ of the output channel audio signal and a multi-channel signal L, $L_s$, R, $R_s$, C and LFE are needed. And, the corresponding relation fomula can be defined as follows.

$$L_t=L+L_s+C/\sqrt{2}+LFE/\sqrt{2}$$

$$R_t=R+R_s+C/\sqrt{2}+LFE/\sqrt{2} \quad \text{[Formula 16]}$$

Since the relation formula like Formula 16 can be varied according to how to define an output channel audio signal, it can be defined in a manner of formula different from Formula 16. For instance, '$1/\sqrt{2}$' in $C/\sqrt{2}$ or $LFE/\sqrt{2}$ can be '0' or '1'.

Formula 16 can bring out Formula 17 as follows.

$$P_{Lt}=P_L+P_{Ls}+P_c/2+P_{LFE}/2$$

$$P_{Rt}=P_R+P_{Rs}+P_c/2+P_{LFE}/2 \quad \text{[Formula 17]}$$

It is able to represent $CLD_\beta$ according to Formula 14 or Formula 15 using $P_{Lt}$ and $P_{Rt}$. And, '$P_{Lt}$ and $P_{Rt}$' can be represented according to Formula 15 using $P_L$, $P_{Ls}$, $P_c$, $P_{LFE}$, $P_R$ and $P_{Rs}$. So, it is needed to find a relation formula enabling the $P_L$, $P_{Ls}$, $P_c$, $P_{LFE}$, $P_R$ and $P_{Rs}$ to be represented using spatial parameters $CLD_0$ to $CLD_4$.

Meanwhile, in case of the tree configuration shown in FIG. 6, the relation between a multi-channel audio signal (L, R, C, LFE, $L_3$, $R_s$) and a mono downmixed channel signal m is shown as follows.

$$\begin{bmatrix} L \\ Ls \\ R \\ Rs \\ C \\ LFE \end{bmatrix} = \begin{bmatrix} D_L \\ D_{Ls} \\ D_R \\ D_{Rs} \\ D_C \\ D_{LFE} \end{bmatrix} m = \begin{bmatrix} c_{1,OTT3}c_{1,OTT1}c_{1,OTT0} \\ c_{2,OTT3}c_{1,OTT1}c_{1,OTT0} \\ c_{1,OTT4}c_{2,OTT1}c_{1,OTT0} \\ c_{2,OTT4}c_{2,OTT1}c_{1,OTT0} \\ c_{1,OTT2}c_{2,OTT0} \\ c_{2,OTT2}c_{2,OTT0} \end{bmatrix} m, \quad \text{\{Formula 18\}}$$

where $$c_{1,OTT_x} = \sqrt{\frac{10^{\frac{CLD_x}{10}}}{1+10^{\frac{CLD_x}{10}}}},$$

$$c_{2,OTT_x} = \sqrt{\frac{1}{1+10^{\frac{CLD_x}{10}}}}.$$

And, Formula 18 brings about Formula 19 as follows.

$$\begin{bmatrix} P_L \\ P_{Ls} \\ P_R \\ P_{Rs} \\ P_C \\ P_{LFE} \end{bmatrix} = \begin{bmatrix} (c_{1,OTT3}c_{1,OTT1}c_{1,OTT0})^2 \\ (c_{2,OTT3}c_{1,OTT1}c_{1,OTT0})^2 \\ (c_{1,OTT4}c_{2,OTT1}c_{1,OTT0})^2 \\ (c_{2,OTT4}c_{2,OTT1}c_{1,OTT0})^2 \\ (c_{1,OTT2}c_{2,OTT0})^2 \\ (c_{2,OTT2}c_{2,OTT0})^2 \end{bmatrix} m^2, \quad \text{[Formula 19]}$$

where, $$c_{1,OTT_x} = \sqrt{\frac{10^{\frac{CLD_x}{10}}}{1+10^{\frac{CLD_x}{10}}}},$$

$$c_{2,OTT_x} = \sqrt{\frac{1}{1+10^{\frac{CLD_x}{10}}}}.$$

In particular, by inputting Formula 19 to Formula 17 and by inputting Formula 17 to Formula 14 or Formula 15, it is able to represent the combined spatial parameter $CLD_\beta$ in a manner of combining spatial parameters $CLD_0$ to $CLD_4$.

Meanwhile, an expansion formula resulting from inputting Formula 19 to $P_L+P_{Ls}$ in Formula 17 is shown in Formula 20.

$$P_L+P_{Ls}=[(c_{1,OTT3})^2+(c_{2,OTT3})^2](c_{1,OTT1}c^*_{1,OTT0})^2*m^2 \quad \text{[Formula 20]}$$

In this case, according to definitions of $c_1$ and $c_2$ (cf. Formula 5), since $(c_{1,x})^2+(c_{2,x})^2=1$, it results in $(c_{1,OTT3})^2+(c_{2,OTT3})^2=1$.

So, Formula 20 can be briefly summarized as follows.

$$P_{L_}=P_L+P_{Ls}=(c_{1,OTT1}*c_{1,OTT0})^2*m^2 \quad \text{[Formula 21]}$$

On the other hand, an expansion formula resulting from inputting Formula 19 to $P_R+P_{Rs}$ in Formula 17 is shown in Formula 22.

$$P_R+P_{Rs}=[(c_{1,OTT4})^2+(c_{2,OTT4})^2](c_{1,OTT1}*c_{1,OTT0})^2*m^2 \quad \text{[Formula 22]}$$

In this case, according to definitions of $c_1$ and $c_2$ (cf. Formula 5), since $(c_{1,x})^2+(c_{2,x})^2=1$, it results in $(c_{1,OTT4})^2+(c_{2,OTT4})^2=1$.

So, Formula 22 can be briefly summarized as follows.

$$P_{R_}=P_R+P_{Rs}=(c_{2,OTT1}*c_{1,OTT0})^2*m^2 \quad \text{[Formula 23]}$$

On the other hand, an expansion formula resulting from inputting Formula 19 to $P_c/2+P_{LFE}/2$ in Formula 17 is shown in Formula 24.

$$P_c/2+P_{LFE}/2=[(c_{1,OTT2})^2+(c_{2,OTT2})^2](c_{2,OTT0})^2*m^2/2 \quad \text{[Formula 24]}$$

In this case, according to definitions of $c_1$ and $c_2$ (cf. Formula 5), since $(c_{1,x})^2+(c_{2,x})^2=1$, it results in $(c_{1,OTT2})^2+(c_{2,OTT2})^2=1$.

So, Formula 24 can be briefly summarized as follows.

$$P_c/2+P_{LFE}/2=(c_{2,OTT0})^2*m^2/2 \quad \text{[Formula 25]}$$

Therefore, by inputting Formula 21, formula 23 and Formula 25 to Formula 17 and by inputting Formula 17 to Formula 14 or Formula 15, it is able to represent the combined spatial parameter $CLD_\beta$ in a manner of combining spatial parameters $CLD_0$ to $CLD_4$.

(2)-1-2-b. Derivation of $ICC_\beta$

First of all, since $ICC_\beta$ is a correlation between a left output signal $L_t$ and a right output signal $R_t$, a result from inputting the left output signal $L_t$ and the right output signal $R_t$ to a corresponding definition formula is shown as follows.

$$ICC_\beta = \frac{P_{LtRt}}{\sqrt{P_{Lt}P_{Rt}}}, \text{ where} \quad \text{[Formula 26]}$$

$$P_{x_1x_2} = \sum x_1 x_2^*.$$

In Formula 26, $P_{Lt}$ and $P_{Rt}$ can be represented according to Formula 19 using $CLD_0$ to $CLD_4$. And. $P_{Lt}P_{Rt}$ can be expanded in a manner of Formula 27.

$$P_{LtRt}=P_{L_R_}+P_c/2+P_{LFE}/2 \quad \text{[Formula 27]}$$

In Formula 27, '$P_c/2+P_{LFE}/2$' can be represented as $CLD_0$ to $CLD_4$ according to Formula 19. And, $P_{L_R_}$ can be expanded according to ICC definition as follows.

$$ICC_1=P_{L_R_}/\sqrt{(P_{L_}P_{R_})} \quad \text{[Formula 28]}$$

If $\sqrt{(P_{L_}P_{R_})}$ is transposed, Formula 29 is obtained.

$$P_{L_R_}=ICC_1*\sqrt{(P_{L_}P_{R_})} \quad \text{[Formula 29]}$$

In Formula 29, $P_{L_}$ and $P_{R_}$ can be represented as $CLD_0$ to $CLD_4$ according to Formula 21 and Formula 23. A formula resulting from inputting Formula 21 and Formula 23 to Formula 29 corresponds to Formula 30.

$$P_{L_R_}=ICC_1*c_{1,OTT1}*c_{1,OTT0}*c_{2,OTT1}*c_{1,OTT0}*m^2 \quad \text{[Formula 30]}$$

In summary, by inputting Formula 30 to Formula 27 and by inputting Formula 27 and Formula 17 to Formula 26, it is able to represent a combined spatial parameter $ICC_\beta$ as spatial parameters $CLD_0$ to $CLD_4$ and $ICC_1$.

The above-explained spatial parameter modifying methods are just one embodiment. And, in finding $P_x$ or $P_{xy}$, it is apparent that the above-explained formulas can be varied in various forms by considering correlations (e.g., $ICC_0$, etc.) between the respective channels as well as signal energy in addition.

(2)-2. Combined Spatial Information Having Surround Effect

First of all, in case of considering sound paths to generate combined spatial information by combining spatial information, it is able to bring about a virtual surround effect.

The virtual surround effect or virtual 3D effect is able to bring about an effect that there substantially exists a speaker of a surround channel without the speaker of the surround channel. For instance, 5.1-channel audio signal is outputted via two stereo speakers.

A sound path may correspond to spatial filter information. The spatial filter information is able to use a function named HRTF (head-related transfer function), which is not limited by the present invention. The spatial filter information is able to include a filter parameter. By inputting the filter parameter and spatial parameters to a conversion formula, it is able to generate a combined spatial parameter. And, the generated combined spatial parameter may include filter coefficients.

Hereinafter, assuming that a multi-channel audio signal is 5-channels and that an output channel audio signal of three channels is generated, a method of considering sound paths to generate combined spatial information having a surround effect is explained as follows.

Figure 7:
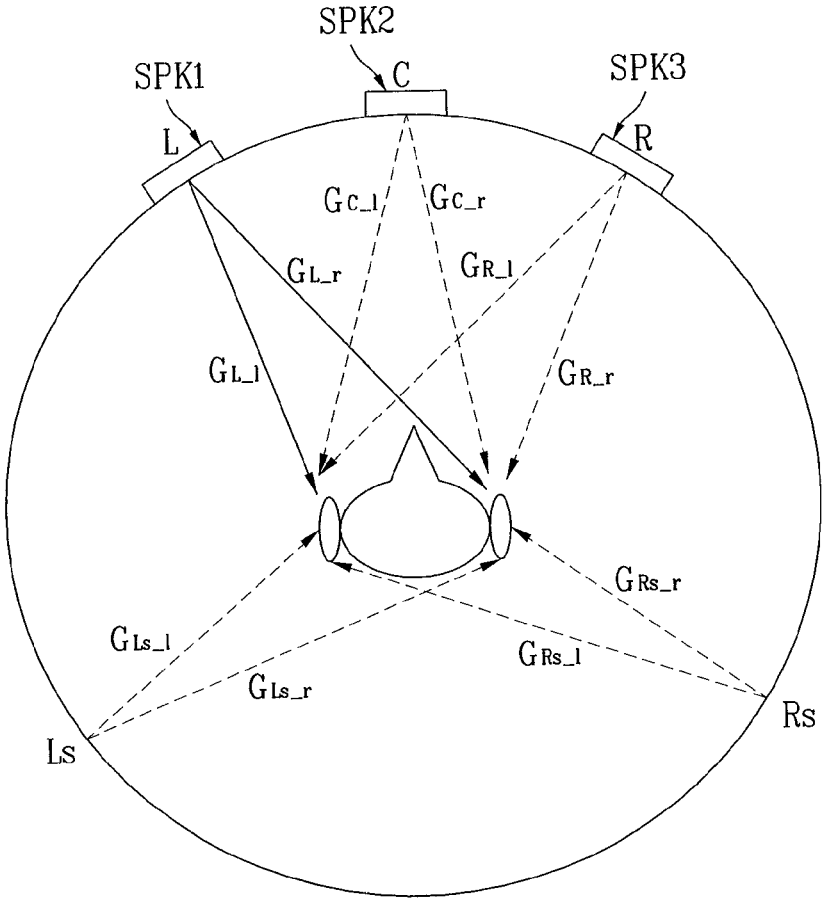
FIG. 7 is a diagram of sound paths from speakers to a listener, in which positions of the speakers are shown.

FIG. 7 is a diagram of sound paths from speakers to a listener, in which positions of the speakers are shown.

Referring to FIG. 7, positions of three speakers SPK1, SPK2 and SPK3 are left front L, center C and right R, respectively. And, positions of virtual surround channels are left surround Ls and right surround Rs, respectively.

Sound paths to positions r and l of right and left ears of a listener from the positions L, C and R of the three speakers and positions Ls and Rs of virtual surround channels, respectively are shown. An indication of '$G_{x_y}$' indicates the sound path from the position x to the position y. For instance, an indication of '$G_{L_r}$' indicates the sound path from the position of the left front L to the position of the right ear r of the listener.

If there exist speakers at five positions (i.e., speakers exist at left surround Ls and right surround Rs as well) and if the listener exists at the position shown in FIG. 7, a signal $L_o$ introduced into the left ear of the listener and a signal $R_0$ introduced into the right ear of the listener are represented as Formula 31.

$$L_o=L*G_{L_l}+C*G_{c_l}+R*G_{R_l}+LS*G_{Ls_l}+Rs*G_{Rs_l}$$

$$R_o=L*G_{L_r}+C*G_{c_r}+R*G_{R_r}+Ls*G_{Ls_r}+Rs*G_{Rs_r}, \quad \text{[Formula 31]}$$

where L, C, R, Ls and Rs are channels at positions, respectively, $G_{x_y}$ indicates a sound path from a position x to a position y, and '*' indicates a convolution.

Yet, as mentioned in the foregoing description, in case that the speakers exist at the three positions L, C and R only, a signal $L_{0_real}$ introduced into the left ear of the listener and a signal $R_{0_real}$ introduced into the right ear of the listener are represented as follows.

$$L_{0_real}=L*G_{L_l}+C*G_{c_l}+R*G_{R_l}$$

$$R_{0_real}=L*G_{L_r}C*G_{c_r}+R*G_{R_r} \quad \text{[Formula 32]}$$

Since surround channel signals Ls and Rs are not taken into consideration by the signals shown in Formula 32, it is unable to bring about a virtual surround effect. In order to bring about the virtual surround effect, a Ls signal arriving at the position (l, r) of the listener from the speaker position Ls is made equal to a Ls signal arriving at the position (l, r) of the listener from the speaker at each of the three positions L, C and R different from the original position Ls. And, this is identically applied to the case of the right surround channel signal Rs as well.

Looking into the left surround channel signal Ls, in case that the left surround channel signal Ls is outputted from the speaker at the left surround position Ls as an original position, signals arriving at the left and right ears l and r of the listener are represented as follows.

$$\text{'}Ls*G_{Ls_l}\text{'}, \text{'}Ls*G_{Ls_r}\text{'} \quad \text{[Formula 33]}$$

And, in case that the right surround channel signal Rs is outputted from the speaker at the right surround position Rs as an original position, signals arriving at the left and right ears l and r of the listener are represented as follows.

$$\text{'}Rs*G_{Rs_l}\text{'}, \text{'}Rs*G_{Rs_r}\text{'} \quad \text{[Formula 34]}$$

In case that the signals arriving at the left and right ears l and r of the listener are equal to components of Formula 33 and Formula 34, even if they are outputted via the seakers of any position (e.g., via the speaker SPK1 at the left front position), the listener is able to sense as if speakers exist at the left and right surruond positions Ls and Rs, respectively.

Meanwhile, in case that components shown in Formula 33 are outputted from the speaker at the left surround position Ls, they are the signals arriving at the left and right ears l and r of the listener, respectively. So, if the components shown in Formula 33 are outputted intact from the speaker SPK1 at the left front position, signals arriving at the left and right ears 1 and r of the listener can be represented as follows.

$$\text{'}Ls*G_{Ls_l}*G_{L_l}\text{'}, \text{'}Ls*G_{Ls_r}*G_{L_r}\text{'} \quad \text{[Formula 35]}$$

Looking into Formula 35, a component '$G_{L_l}$' (or '$G_{L_r}$') correpsonding to the sound path from the left front position L to the left ear l (or the right ear r) of the listener is added.

Yet, the signals arriving at the left and right ears 1 and r of the listener should be the components shown in Formula 33 instead of Formula 35. In case that a sound outputted from the speaker at the left front position L arrives at the listener, the component '$G_{L_l}$' (or '$G_{L_r}$') is added. So, if the components shown in Formula 33 are outputted from the speaker SPK1 at the left front position, an inverse function '$G_{L_l}^{-1}$' (or '$G_{L_r}^{-1}$') of the '$G_{L_l}$' (or '$G_{L_r}$') should be taken into consideration for the sound path. In other words, in case that the components correpsonding to Formula 33 are outputted from the speaker SPK1 at the left front position L, they have to be modified as the following formula.

$$\text{'}Ls*G_{Ls_l}*G_{L_l}^{-1}\text{'}, \text{'}Ls*G_{Ls_r}*G_{L_r}^{-1}\text{'} \quad \text{[Formula 36]}$$

And, in case that the components correposnding to Formula 34 are outputted from the speaker SPK1 at the left front position L, they have to be modified as the following formula.

$$\text{'}Rs*G_{Rs_l}*G_{L_l}^{-1}\text{'}, \text{'}Rs*G_{Rs_r}*G_{L_l}^{-1}\text{'} \quad \text{[Formula 37]}$$

So, the signal L' outputted from the speaker SPK1 at the left front position L is summarized as follows.

$$L'=L+Ls*G_{Ls_l}*G_{L_l}^{-1}+Rs*G_{Rs_l}*G_{L_l}^{-1} \quad \text{[Formula 38]}$$

(Components $Ls*G_{Ls_r}*G_{L_r}^{-1}$ and $Rs*G_{Rs_r}*G_{L_l}^{-1}$ are omitted.)

If the signal, which is shown in Formula 38 to be outputted from the speaker SPK1 at the left front position L, arrives at the position of the left ear L of the listener, a sound path factor '$G_{L_l}$' is added. So, '$G_{L_l}$' terms in formula 38 are cancelled out, whereby factors shown in Formula 33 and Formula 34 eventually remain.

Figure 8:
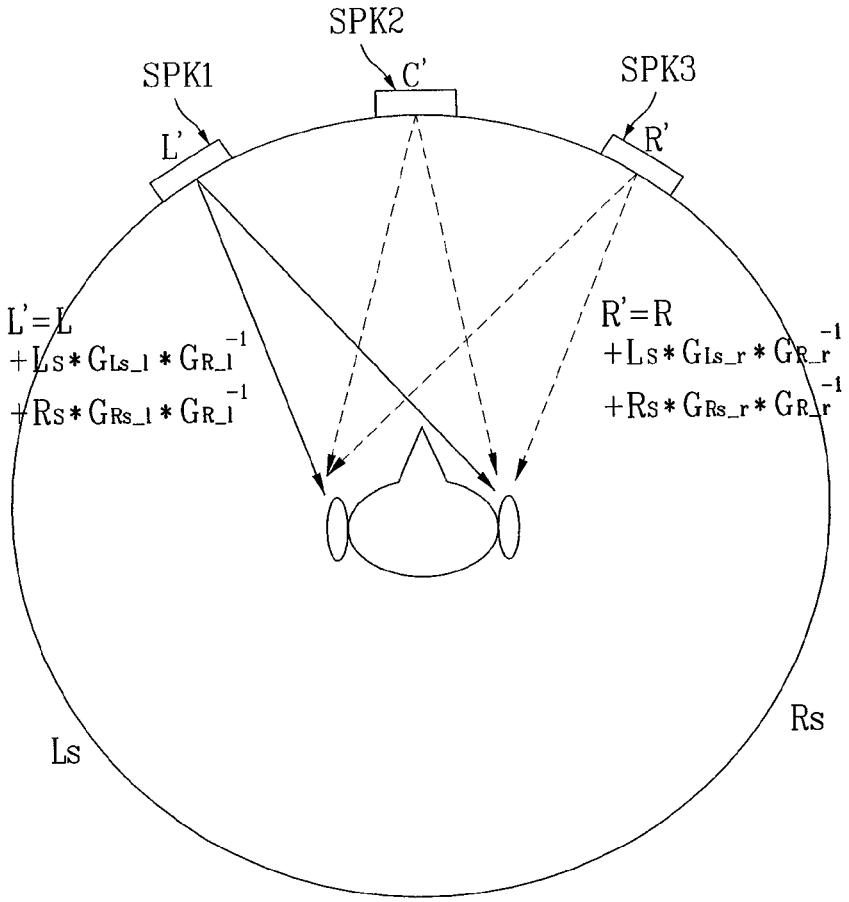
FIG. 8 is a diagram to explain a signal outputted from each speaker position for a surround effect.

FIG. 8 is a diagram to explain a signal outputted from each speaker position for a virtual surround effect.

Referring to FIG. 8, if signals Ls and Rs outputted from surround positions Ls and Rs are made to be included in a signal L' outputted from each speaker position SPK1 by considering sound paths, they correspond to Formula 38.

In Formula 38, $G_{Ls_l}*G_{L_l}^{-1}$ is briefly abbreviated $H_{Ls_L}$ as follows.

$$L'=L+Ls*H_{Ls_L}+Rs*H_{Rs_L} \quad \text{[Formula 39]}$$

For instance, a signal C' outputted from a speaker SPK2 at a center position C is summarized as follows.

$$C'=C+Ls*H_{Ls_C}+Rs*H_{Rs_C} \quad \text{[Formula 40]}$$

For another instance, a signal R' outputted from a speaker SPK3 at a right front position R is summarized as follows.

$$R'=R+Ls*H_{Ls_R}+Rs*H_{Rs_R} \quad \text{[Formula 41]}$$

Figure 9:
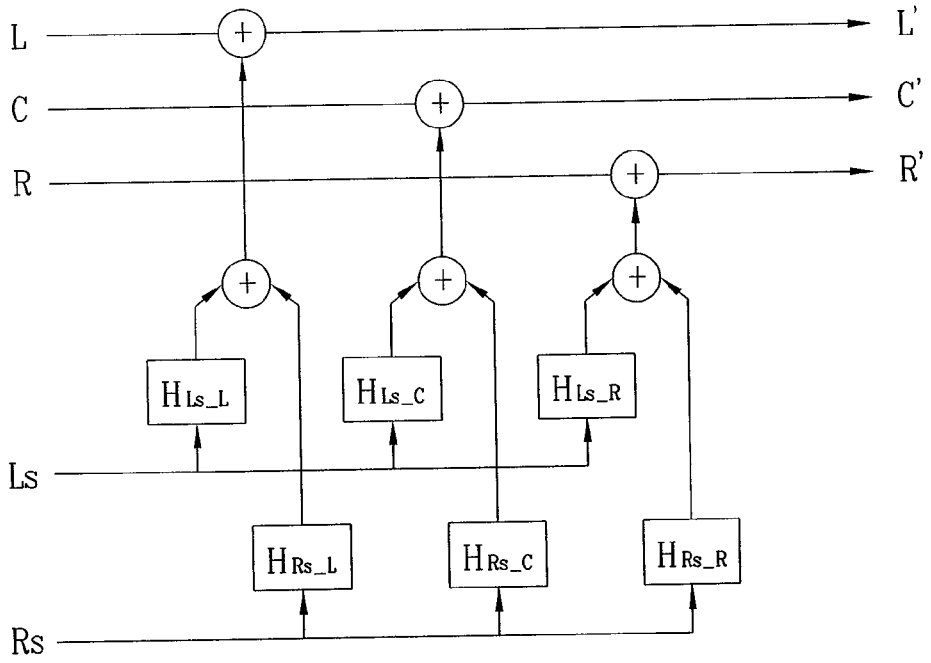
FIG. 9 is a conceptional diagram to explain a method of generating a 3-channel signal using a 5-channel signal.

FIG. 9 is a conceptional diagram to explain a method of generating a 3-channel signal using a 5-channel signal like Formula 38, Formula 39 or Formula 40.

In case of generating a 2-channel signal R' and L' using a 5-channel signal or in case of not including a surround channel signal Ls or Rs in a center channel signal C', $H_{Ls_C}$ or $H_{Rs_C}$ becomes 0.

For convenience of implementation, $H_{x_y}$ can be variously modified in such a manner that $H_{x_y}$ is replaced by $G_{x_y}$ or that $H_{x_y}$ is used by considering cross-talk.

The above detailed explanation relates to one example of the combined spatial information having the surround effect. And, it is apparent that it can be varied in various forms according to a method of applying spatial filter information. As mentioned in the foregoing description, the signals outputted via the speakers (in the above example, left front channel L', right front channel R' and center channel C') according to the above process can be generated from the downmix audio signal using the combined spatial information, an more particularly, using the combined spatial parameters.

(3) Expanded Spatial Information

First of all, by adding extended spatial information to spatial information, it is able to generate expanded spatial information. And, it is able to upmix an audio signal using the extended spatial information. In the corresponding upmixing process, an audio signal is converted to a primary upmixing audio signal based on spatial information and the primary upmixing audio signal is then converted to a secondary upmixing audio signal based on extended spatial information.

In this case, the extended spatial information is able to include extended channel configuration information, extended channel mapping information and extended spatial parameters.

The extended channel configuration information is information for a configurable channel as well as a channel that can be configured by tree configuration information of spatial information. The extended channel configuration information may include at least one of a division identifier and a non-division identifier, which will be explained in detail later. The extended channel mapping information is position information for each channel that configures an extended channel. And, the extended spatial parameters can be used for upmixing one channel into at least two channels. The extended spatial parameters may include inter-channel level differences.

The above-explained extended spatial information may be included in spatial information after having been generated by an encoding apparatus (i) or generated by a decoding apparatus by itself (ii). In case that extended spatial information is generated by an encoding apparatus, a presence or non-presence of the extended spatial information can be decided based on an indicator of spatial information. In case that extended spatial information is generated by a decoding apparatus by itself, extended spatial parameters of the extended spatial information may result from being calculated using spatial parameters of spatial information.

Meanwhile, a process for upmixing an audio signal using the expanded spatial information generated on the basis of the spatial information and the extended spatial information can be executed sequentially and hierarchically or collectively and synthetically. If the expanded spatial information can be calculated as one matrix based on spatial information and extended spatial information, it is able to upmix a downmix audio signal into a multi-channel audio signal collectively and directly using the matrix. In this case, factors configuring the matrix can be defined according to spatial parameters and extended spatial parameters.

Hereinafter, after completion of explaining a case that extended spatial information generated by an encoding apparatus is used, a case of generating extended spatial information in a decoding apparatus by itself will be explained.

(3)-1: Case of Using Extended Spatial Information Generated by Encoding Apparatus: Arbitrary Tree Configuration First of all, expanded spatial information is generated by an encoding apparatus in being generated by adding extended spatial information to spatial information. And, a case that a decoding apparatus receives the extended spatial information will be explained. Besides, the extended spatial information may be the one extracted in a process that the encoding apparatus downmixes a multi-channel audio signal.

As mentioned in the foregoing description, extended spatial information includes extended channel configuration information, extended channel mapping information and extended spatial parameters. In this case, the extended channel configuration information may include at least one of a division identifier and a non-division identifier. Hereinafter, a process for configuring an extended channel based on array of the division and non-division identifiers is explained in detail as follows.

Figure 10:
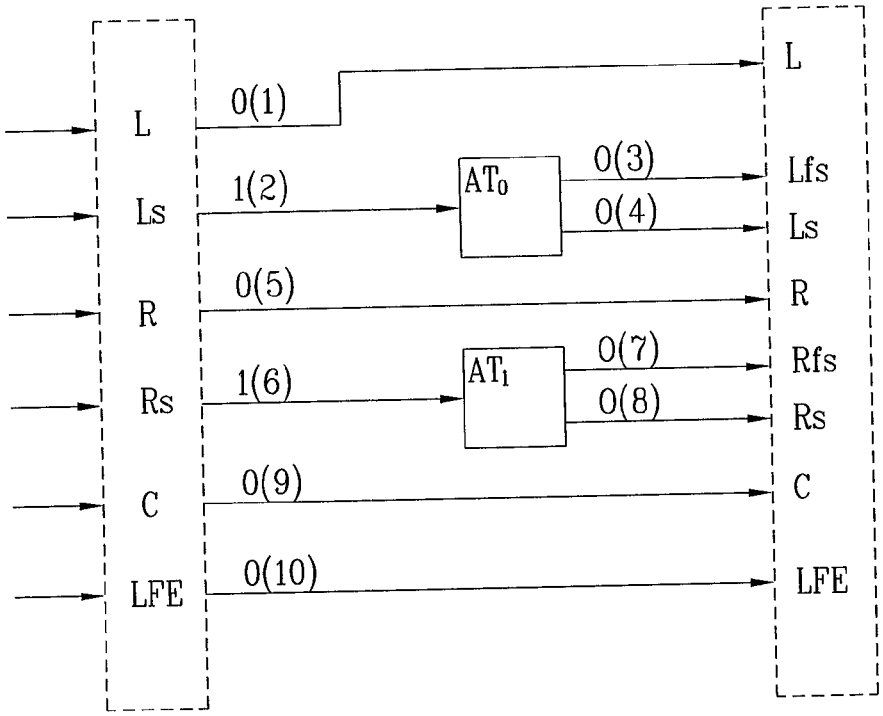
FIG. 10 is a diagram of an example of configuring extended channels based on extended channel configuration information.

FIG. 10 is a diagram of an example of configuring extended channels based on extended channel configuration information.

Referring to a lower end of FIG. 10, 0's and 1's are repeatedly arranged in a sequence. In this case, '0' means a non-division identifier and '1' means a division identifier. A non-division identifier 0 exists in a first order (1), a channel matching the non-division identifier 0 of the first order is a left channel L existing on a most upper end. So, the left channel L matching the non-division identifier 0 is selected as an output channel instead of being divided. In a second order (2), there exists a division identifier 1. A channel matching the division identifier is a left surround channel Ls next to the left channel L. So, the left surround channel Ls matching the division identifier 1 is divided into two channels.

Since there exist non-division identifiers 0 in a third order (3) and a fourth order (4), the two channels divided from the left surround channel Ls are selected intact as output channels without being divided. Once the above process is repeated to a last order (10), it is able to configure entire extended channels.

The channel dividing process is repeated as many as the number of division identifiers 1, and the process for selecting a channel as an output channel is repeated as many as the number of non-division identifiers 0. So, the number of channel dividing units AT0 and AT1 are equal to the number (2) of the division identifiers 1, and the number of extended channels (L, Lfs, Ls, R, Rfs, Rs, C and LFE) are equal to the number (8) of non-division identifiers 0.

Meanwhile, after the extend channel has been configured, it is able to map a position of each output channel using extended channel mapping information. In case of FIG. 10, mapping is carried out in a sequence of a left front channel L, a left front side channel Lfs, a left surround channel Ls, a right front channel R, a right front side channel Rfs, a right surround channel Rs, a center channel C and a low frequency channel LFS.

As mentioned in the foregoing description, an extended channel can be configured based on extended channel configuration information. For this, a channel dividing unit dividing one channel into at least two channels is necessary. In dividing one channel into at least two channels, the channel dividing unit is able to use extended spatial parameters. Since the number of the extended spatial parameters is equal to that of the channel dividing units, it is equal to the number of division identifiers as well. So, the extended spatial parameters can be extracted as many as the number of the division identifiers.

Figure 11:
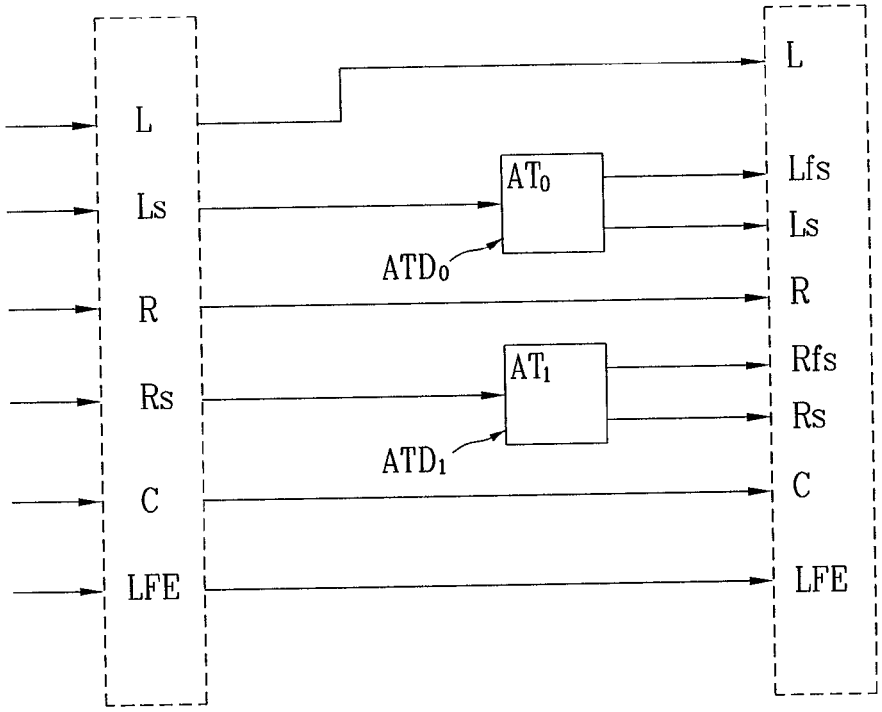
FIG. 11 is a diagram to explain a configuration of the extended channels shown in FIG. 10 and the relation with extended spatial parameter.

FIG. 11 is a diagram to explain a configuration of the extended channels shown in FIG. 10 and the relation with extended spatial parameters.

Referring to FIG. 11, there are two channel division units $AT_0$ and $AT_1$ and extended spatial parameters $ATD_0$ and $ATD_1$ applied to them, respectively are shown.

In case that an extended spatial parameter is an inter-channel level difference, a channel dividing unit is able to decide levels of two divided channels using the extended spatial parameter.

Thus, in performing upmixing by adding extended spatial information, the extended spatial parameters can be applied not entirely but partially.

(3)-2. Case of Generating Extended Spatial Information: Interpolation/Extrapolation First of all, it is able to generate expanded spatial information by adding extended spatial information to spatial information. A case of generating extended spatial information using spatial information will be explained in the following description. In particular, it is able to generate extended spatial information using spatial parameters of spatial information. In this case, interpolation, extrapolation or the like can be used.

(3)-2-1. Extension to 6.1-Channels

In case that a multi-channel audio signal is 5.1-channels, a case of generating an output channel audio signal of 6.1-channels is explained with reference to examples as follows.

Figure 12:
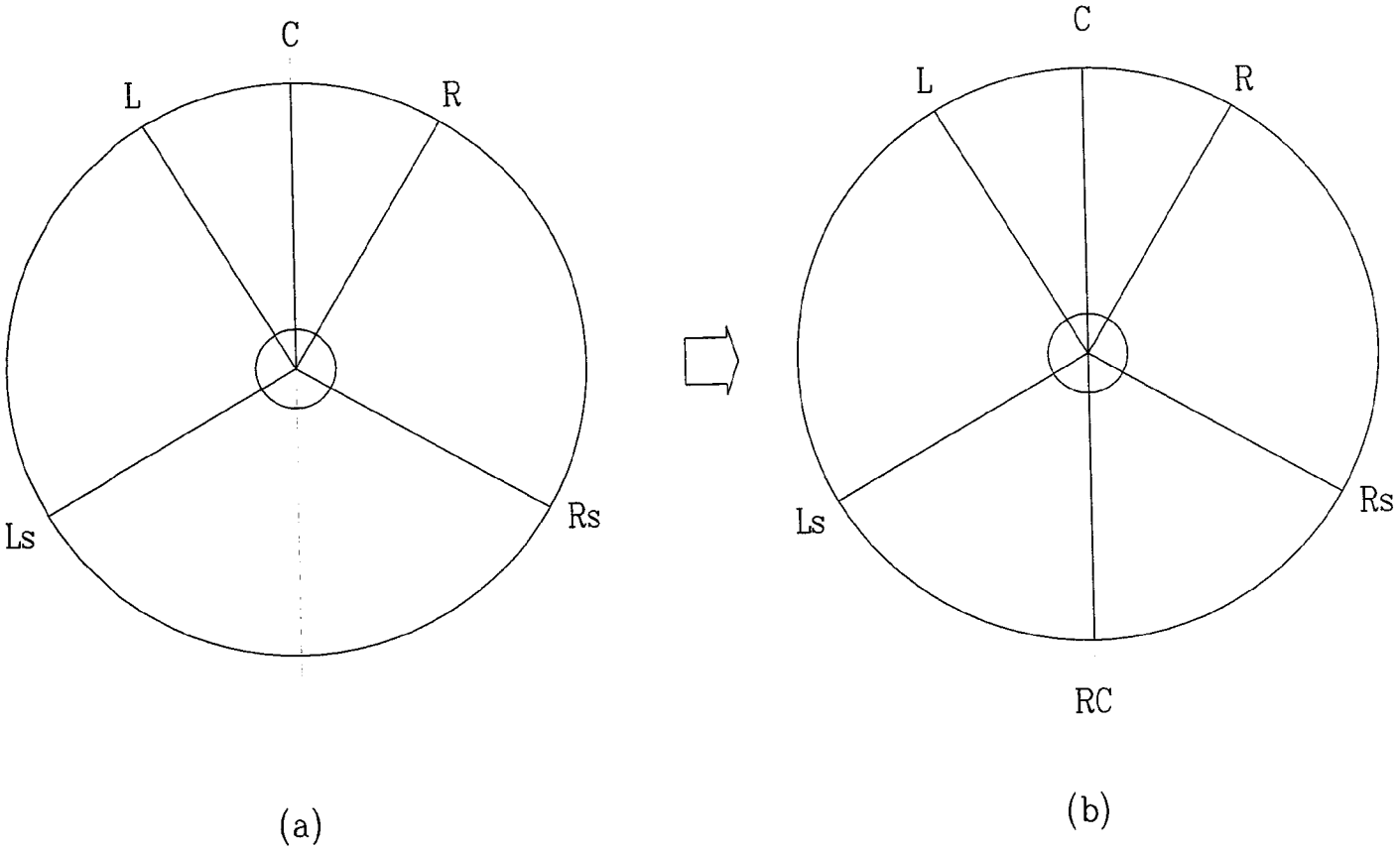
FIG. 12 is a diagram of positions of a multi-channel audio signal of 5.1-channels and an output channel audio signal of 6.1-channels.

FIG. 12 is a diagram of a position of a multi-channel audio signal of 5.1-channels and a position of an output channel audio signal of 6.1-channels.

Referring to (a) of FIG. 12, it can be seen that channel positions of a multi-channel audio signal of 5.1-channels are a left front channel L, a right front channel R, a center channel C, a low frequency channel (not shown in the drawing) LFE, a left surround channel Ls and a right surround channel Rs, respectively.

In case that the multi-channel audio signal of 5.1-channels is a downmix audio signal, if spatial parameters are applied to the downmix audio signal, the downmix audio signal is upmixed into the multi-channel audio signal of 5.1-channels again.

Yet, a channel signal of a rear center RC, as shown in (b) of FIG. 12, should be further generated to upmix a downmix audio signal into a multi-channel audio signal of 6.1-channels.

The channel signal of the rear center RC can be generated using spatial parameters associated with two rear channels (left surround channel Ls and right surround channel Rs). In particular, an inter-channel level difference (CLD) among spatial parameters indicates a level difference between two channels. So, by adjusting a level difference between two channels, it is able to change a position of a virtual sound source existing between the two channels.

A principle that a position of a virtual sound source varies according to a level difference between two channels is explained as follows.

Figure 13:
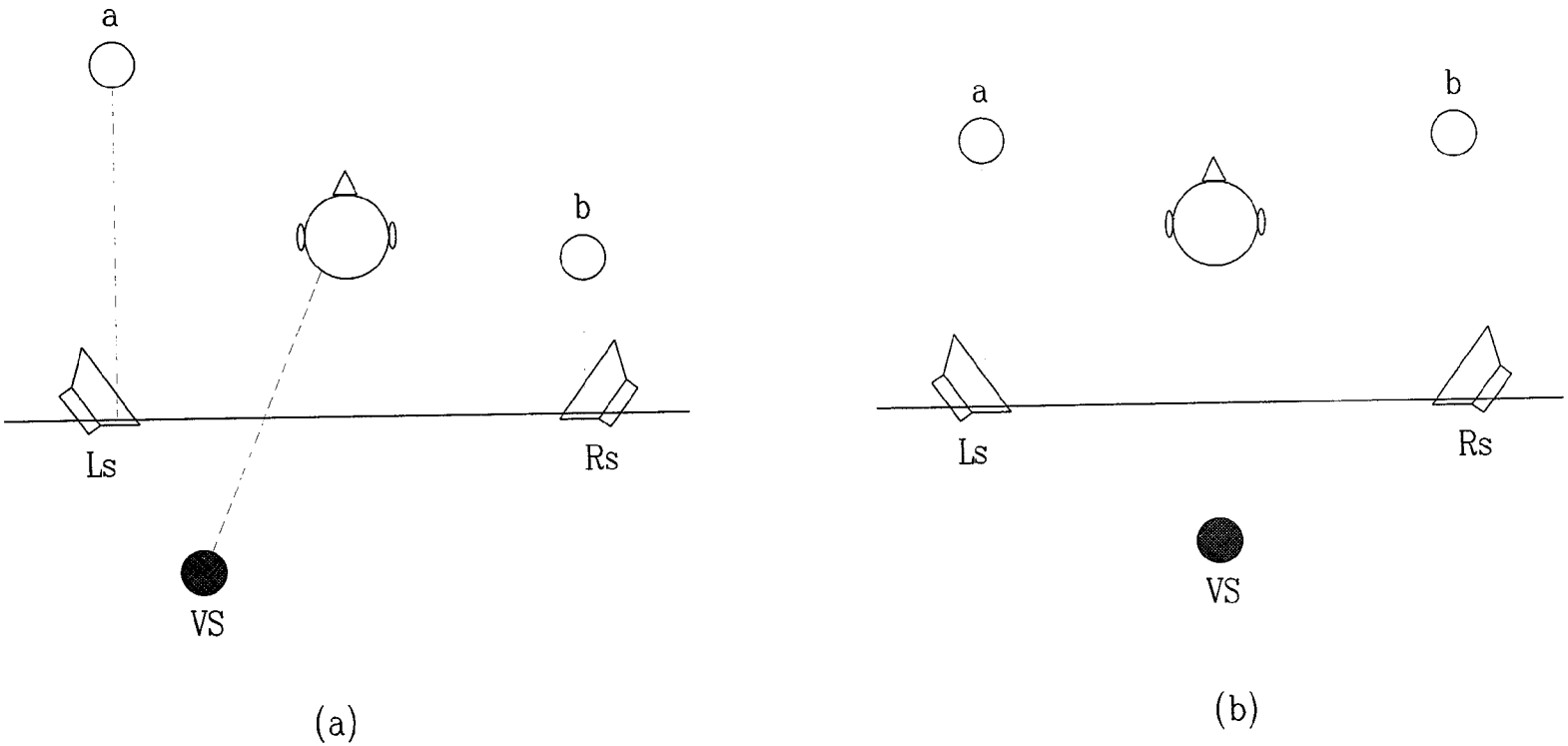
FIG. 13 is a diagram to explain the relation between a virtual sound source position and a level difference between two channels.

FIG. 13 is a diagram to explain the relation between a virtual sound source position and a level difference between two channels, in which levels of left and surround channels Ls and Rs are 'a' and 'b', respectively.

Referring to (a) of FIG. 13, in case that a level a of a left surround channel Ls is greater than that b of a right surround channel Rs, it can be seen that a position of a virtual sound source VS is closer to a position of the left surround channel LS than a position of the right surround channel Rs.

If an audio signal is outputted from two channels, a listener feels that a virtual sound source substantially exists between the two channels. In this case, a position of the virtual sound source is closer to a position of the channel having a level higher than that of the other channel.

In case of (b) of FIG. 13, since a level a of a left surround channel Ls is almost equal to a level b of a right surround channel Rs, a listener feels that a position of a virtual sound source exists at a center between the left surround channel Ls and the right surround channel Rs.

Hence, it is able to decide a level of a rear center using the above principle.

Figure 14:
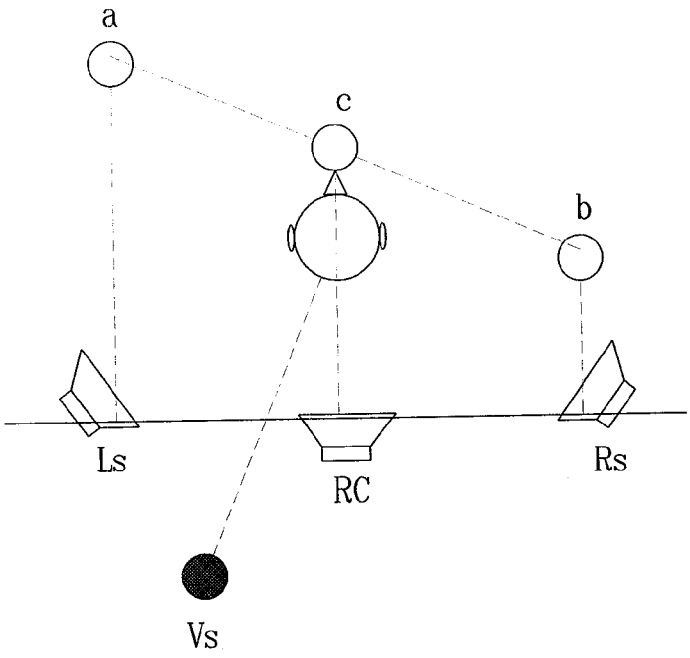
FIG. 14 is a diagram to explain levels of two rear channels and a level of a rear center channel.

FIG. 14 is a diagram to explain levels of two rear channels and a level of a rear center channel.

Referring to FIG. 14, it is able to calculate a level c of a rear center channel RC by interpolating a difference between a level a of a left surround channel Ls and a level b of a right surround channel Rs. In this case, non-linear interpolation can be used as well as linear interpolation for the calculation.

A level c of a new channel (e.g., rear center channel RC) existing between two channels (e.g., Ls and Rs) can be calculated according to linear interpolation by the following formula.

$$c=a*k+b*(1-k), \quad \text{[Formula 40]}$$

where 'a' and 'b' are levels of two channels, respectively and 'k' is a relative position beta channel of level-a, a channel of level-b and a channel of level-c.

If a channel (e.g., rear center channel RC) at a level-c is located at a center between a channel (e.g., Ls) at a level-a and a channel RS at a level-b, 'k' is 0.5. If 'k' is 0.5, Formula 40 follows Formula 41.

$$c=(a+b)/2 \quad \text{[Formula 41]}$$

According to Formula 41, if a channel (e.g., rear center channel RC) at a level-c is located at a center between a channel (e.g., Ls) at a level-a and a channel RS at a level-b, a level-c of a new channel corresponds to a mean value of levels a and b of previous channels. Besides, Formula 40 and Formula 41 are just exemplary. So, it is also possible to readjust a decision of a level-c and values of the level-a and level-b.

(3)-2-2. Extension to 7.1-Channels

When a multi-channel audio signal is 5.1-channels, a case of attempting to generate an output channel audio signal of 7.1-channels is explained as follows.

Figure 15:
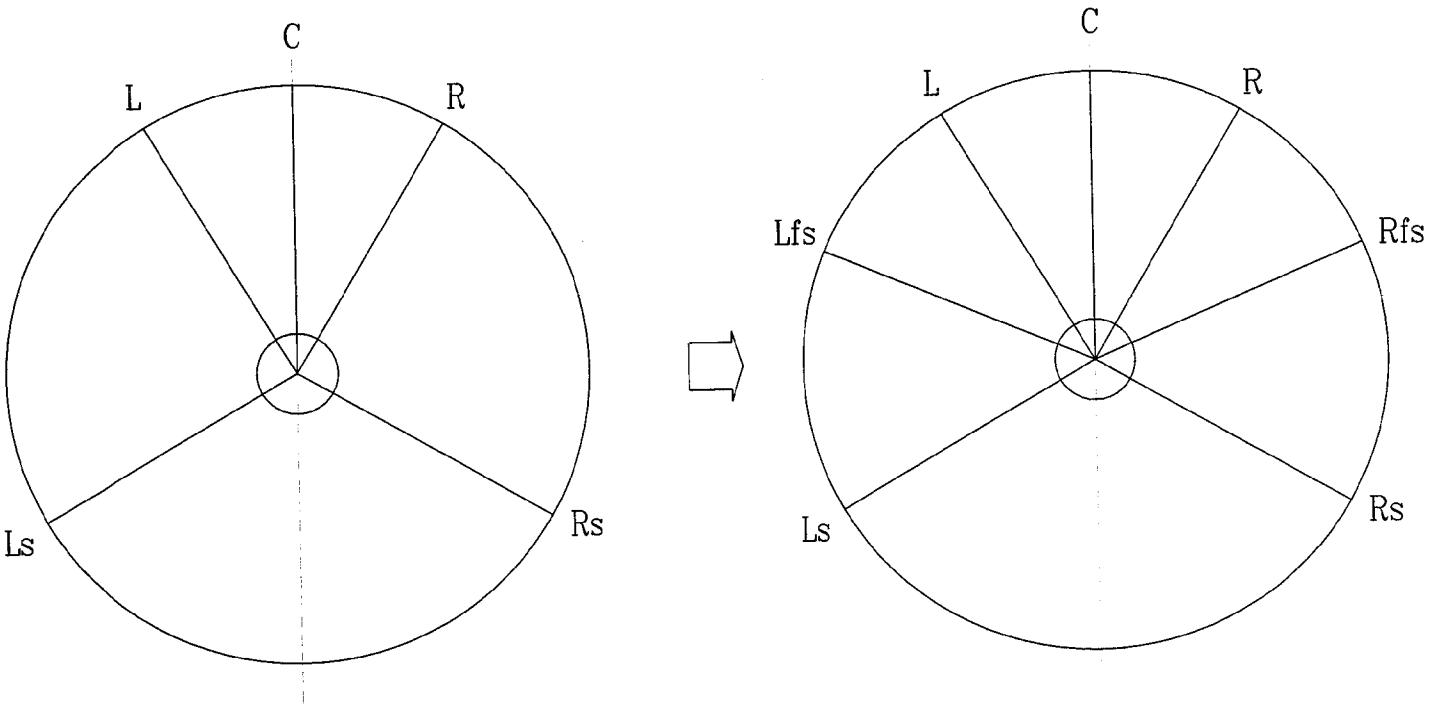
FIG. 15 is a diagram to explain a position of a multi-channel audio signal of 5.1-channels and a position of an output channel audio signal of 7.1-channels.

FIG. 15 is a diagram to explain a position of a multi-channel audio signal of 5.1-channels and a position of an output channel audio signal of 7.1-channels.

Referring to (a) of FIG. 15, like (a) of FIG. 12, it can be seen that channel positions of a multi-channel audio signal of 5.1-channels are a left front channel L, a right front channel R, a center channel C, a low frequency channel (not shown in the drawing) LFE, a left surround channel Ls and a right surround channel Rs, respectively.

In case that the multi-channel audio signal of 5.1-channels is a downmix audio signal, if spatial parameters are applied to the downmix audio signal, the downmix audio signal is upmixed into the multi-channel audio signal of 5.1-channels again.

Yet, a left front side channel Lfs and a right front side channel Rfs, as shown in (b) of FIG. 15, should be further generated to upmix a downmix audio signal into a multi-channel audio signal of 7.1-channels.

Since the left front side channel Lfs is located between the left front channel L and the left surround channel Ls, it is able to decide a level of the left front side channel Lfs by interpolation using a level of the left front channel L and a level of the left surround channel Ls.

Figure 16:
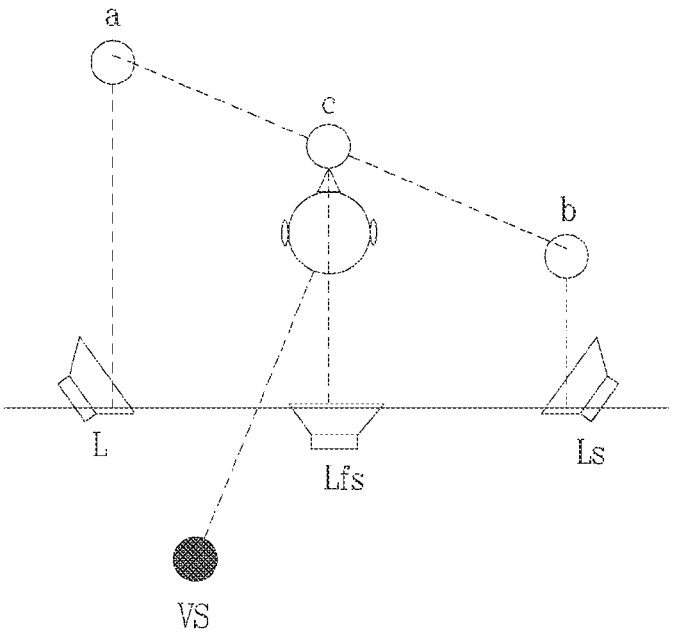
FIG. 16 is a diagram to explain levels of two left channels and a level of a left front side channel (Lfs)

FIG. 16 is a diagram to explain levels of two left channels and a level of a left front side channel (Lfs).

Referring to FIG. 16, it can be seen that a level c of a left front side channel Lfs is a linearly interpolated value based on a level a of a left front channel L and a level b of a left surround channel LS.

Meanwhile, although a left front side channel Lfs is located between a left front channel L and a left surround channel Ls, it can be located outside a left front channel L, a center channel C and a right front channel R. So, it is able to decide a level of the left front side channel Lfs by extrapolation using levels of the left front channel L, center channel C and right front channel R.

Figure 17:
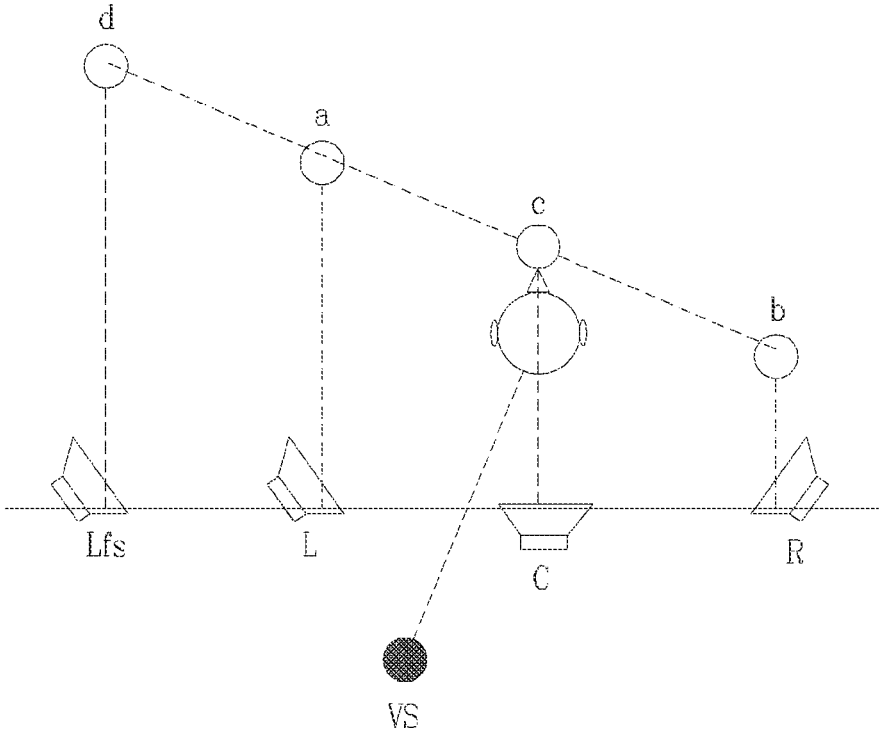
FIG. 17 is a diagram to explain levels of three front channels and a level of a left front side channel (Lfs).

FIG. 17 is a diagram to explain levels of three front channels and a level of a left front side channel.

Referring to FIG. 17, it can be seen that a level d of a left front side channel Lfs is a linearly extrapolated value based on a level a of a left front channel l , a level c of a center channel C and a level b of a right front channel.

In the above description, the process for generating the output channel audio signal by adding extended spatial information to spatial information has been explained with reference to two examples. As mentioned in the foregoing description, in the upmixing process with addition of extended spatial information, extended spatial parameters can be applied not entirely but partially. Thus, a process for applying spatial parameters to an audio signal can be executed sequentially and hierarchically or collectively and synthetically.

INDUSTRIAL APPLICABILITY

Accordingly, the present invention provides the following effects.

First of all, the present invention is able to generate an audio signal having a configuration different from a predetermined tree configuration, thereby generating variously configured audio signals.

Secondly, since it is able to generate an audio signal having a configuration different from a predetermined tree configuration, even if the number of multi-channels before the execution of downmixing is smaller or greater than that of speakers, it is able to generate output channels having the number equal to that of speakers from a downmix audio signal.

Thirdly, in case of generating output channels having the number smaller than that of multi-channels, since a multi-channel audio signal is directly generated from a downmix audio signal instead of downmixing an output channel audio signal from a multi-channel audio signal generated from upmixing a downmix audio signal, it is able to considerably reduce load of operations required for decoding an audio signal.

Fourthly, since sound paths are taken into consideration in generating combined spatial information, the present invention provides a pseudo-surround effect in a situation that a surround channel output is unavailable.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method of decoding an audio signal, comprising:

receiving an encoded bitstream of the audio signal including a downmix audio signal and spatial information, the spatial information including spatial parameters and an indicator, the audio signal and the spatial information generated from a multi-channel audio signal, wherein the spatial parameters include at least inter-channel level difference values (CLDs) and inter-channel-correlation values (ICCs), and the indicator indicates whether an extended spatial parameter is present or not in the spatial information;

receiving the extended spatial parameter from the spatial information when the indicator indicates the extended spatial parameter is present in the spatial information or generating an extended spatial parameter by interpolating or extrapolating the spatial parameters when the indicator indicates the extended spatial parameter is not present in the spatial information;

generating expanded spatial information by adding the extended spatial parameter to the spatial parameters, wherein the extended spatial parameter includes one of the received extended spatial parameter and the generated extended spatial parameter according to the indicator; and generating an expanded output-channel audio signal from the downmix audio signal using the expanded spatial information.

2. An apparatus for decoding an audio signal, comprising:

a demultiplexer configured to separate an encoded bitstream of the audio signal into a downmix audio signal and spatial information;

a core codec decoder configured to decode the downmix audio signal to generate decoded downmix audio signal;

a spatial information decoder configured to decode the spatial information to generate decoded spatial information, the decoded spatial information including spatial parameters and an indicator, the spatial parameters including at least inter-channel level difference values (CLDs) and inter-channel-correlation values (ICCs), and the indicator indicating whether an extended spatial parameter is present or not in the spatial information;

a modified spatial information generator configured to receive the extended spatial parameter from the spatial information when the indicator indicates the extended spatial parameter is present in the spatial information or generate an extended spatial parameter by interpolating or extrapolating the spatial parameters when the indicator indicates the extended spatial parameter is not present in the spatial information, wherein the modified spatial information generating unit further configured to generate expanded spatial information by adding the extended spatial parameter to the spatial parameters, the extended spatial parameter including one of the received extended spatial parameter and the generated extended spatial parameter according to the indicator; and an output channel generator configured to generate an expanded output-channel audio signal from an audio signal using the expanded spatial information.

* * * * *